US011896112B2

(12) United States Patent
Mikuni

(10) Patent No.: US 11,896,112 B2
(45) Date of Patent: Feb. 13, 2024

(54) FEEDING CONTAINER

(71) Applicant: TOKIWA CORPORATION, Nakatsugawa (JP)

(72) Inventor: Ryota Mikuni, Kawaguchi (JP)

(73) Assignee: TOKIWA CORPORATION, Nakatsugawa (JP)

( * ) Notice: Subject to any disclaimer, the term of this patent is extended or adjusted under 35 U.S.C. 154(b) by 66 days.

(21) Appl. No.: 17/712,984

(22) Filed: Apr. 4, 2022

(65) Prior Publication Data

US 2022/0312937 A1 Oct. 6, 2022

(30) Foreign Application Priority Data

Apr. 5, 2021 (JP) ..... 2021-064299

(51) Int. Cl.
*A45D 40/14* (2006.01)
*A45D 40/06* (2006.01)
*A45D 40/00* (2006.01)

(52) U.S. Cl.
CPC ..... *A45D 40/14* (2013.01); *A45D 40/06* (2013.01); *A45D 2040/0018* (2013.01); *A45D 2200/1009* (2013.01); *A45D 2200/1036* (2013.01); *A45D 2200/1072* (2013.01)

(58) Field of Classification Search
CPC ..... A45D 40/14; A45D 2040/0018; A45D 2200/1036; A45D 2200/1009; A45D 2200/1072; A45D 40/12; A45D 40/205; A45D 2040/208; B65D 83/0005; B65D 83/0011
USPC ..... 401/75, 77, 78
See application file for complete search history.

(56) References Cited

U.S. PATENT DOCUMENTS

| | | | | |
|---|---|---|---|---|
| 2,913,103 | A * | 11/1959 | Isele | A45D 40/06 401/78 |
| 4,991,987 | A * | 2/1991 | Holloway | A45D 40/06 401/78 |
| 6,190,074 | B1 * | 2/2001 | Demellier | A45D 40/06 401/78 |
| 7,004,656 | B2 * | 2/2006 | Kurihara | A45D 40/06 401/78 |
| 2004/0265033 | A1 | 12/2004 | Kurihara et al. | |

FOREIGN PATENT DOCUMENTS

| | | | |
|---|---|---|---|
| CN | 207461658 | U | 6/2018 |
| EP | 0726042 | A1 | 2/1996 |
| JP | H06-090819 | A | 4/1994 |
| JP | H11-028117 | A | 2/1999 |
| JP | 2001-231628 | A | 8/2001 |
| JP | 2001-231629 | A | 8/2001 |

(Continued)

*Primary Examiner* — David J Walczak
(74) *Attorney, Agent, or Firm* — Procopio, Cory, Hargreaves & Savitch LLP

(57) ABSTRACT

A feeding container includes a feeding mechanism having a sleeve. In the feeding container, a first groove through which a projection formed in a holding member that holds a coating material passes and a second groove that extends from the first groove to an end surface of the sleeve are formed on an inner surface of the sleeve, and the first groove has a projection holding portion which is configured to accept the projection and disposed at a position away along the first groove from a connection portion of the first groove and the second groove.

7 Claims, 15 Drawing Sheets

(56) References Cited

FOREIGN PATENT DOCUMENTS

| | | | |
|---|---|---|---|
| JP | 2002-085153 | A | 3/2002 |
| JP | 2006-271757 | A | 10/2006 |
| KR | 200335636 | Y1 | 12/2003 |
| WO | 03-028502 | A1 | 4/2003 |

* cited by examiner

FEEDING CONTAINER

CROSS REFERENCE TO RELATED APPLICATIONS

This application is based on Japanese Patent Applications No. 2021-064299 filed on Apr. 5, 2021, the entire contents of which are incorporated herein by reference.

BACKGROUND

The present disclosure relates to a feeding container.

In the related art, various types of feeding containers are known. WO 2003/028502 discloses a stick-type cosmetic container. The stick-type cosmetic container includes a rotational cylinder having a screw formed on an inner surface, a sleeve and a cylindrical inner container filled with a stick-type cosmetic. The sleeve has an inner container guiding groove, and the inner container has a small projection that enters the inner container guiding groove. The inner container guiding groove includes a primary groove and a secondary groove having an inverted J-shape at a lower end of the primary groove.

When the rotational cylinder rotates to a left with respect to the sleeve, a force in a lower leftward direction is applied to the small projection of the inner container by the screw provided in the rotational cylinder. However, since the small projection of the inner container is guided by the inner container guiding groove of the sleeve, the small projection does not move in the lower leftward direction, but moves downward along the inner container guiding groove. When the small projection reaches an entrance of the secondary groove, the small projection moves to a left side, hits a small projection support, and is returned to the primary groove. Thereafter, the small projection moves downward and is stored in a primary groove lowermost part. When the rotational cylinder rotates to a right with respect to the sleeve in a state where the small projection is stored in the primary groove lowermost part, a force in an upper rightward direction is applied to the small projection by the screw in the rotational cylinder, and the small projection rises along the inner container guiding groove. The small projection that rises along the inner container guiding groove reaches an upper end of the screw in the rotational cylinder and stops.

When the inner container is disassembled in a case where the stick-type cosmetic filled in the inner container is used up or the like, the inner container moves to a position where the inner container is movable downward, and the small projection is stored in a lowermost part of the inner container guiding groove. Then, the rotational cylinder rotates to the right and the small projection moves to an entrance position of the secondary groove, and further, after the small projection moves to the left with an appropriate unit such as use of a jig, the rotational cylinder rotates to the left. Accordingly, the inner container passes through the secondary groove that is open downward and is discharged downward. A new inner container is attached by aligning a threaded portion of the rotational cylinder with a position of the secondary groove, passing the small projection of the inner container through an aligned portion, and then rotating the rotational cylinder to the right.

In the stick-type cosmetic container, as described above, when the inner container is disassembled, after the small projection is stored in the lowermost part of the inner container guiding groove, the small projection moves to the entrance position of the secondary groove, and further, after the small projection is moved to the left with the appropriate unit such as the jig, the rotational cylinder rotates to the left. Thus, since the jig or the like is required when the inner container having been filled with the stick-type cosmetic is disassembled, an operation of replacing a coating material such as the cosmetic is complicated.

The new inner container is attached by aligning the position of the secondary groove with the threaded portion of the rotational cylinder, passing the small projection of the inner container through the aligned portion, and then rotating the rotational cylinder to the right. Therefore, when a new coating material is attached, positioning of the secondary groove to the threaded portion, insertion of the small projection into the secondary groove, and rotation of the rotational cylinder are required, and therefore, there is a problem that an operation of attaching the coating material is complicated. Further, when the stick-type cosmetic container falls, the coating material may be unintentionally detached from the stick-type cosmetic container.

An object of the present disclosure is to provide a feeding container in which a coating material is easily replaced.

SUMMARY

According to the present disclosure, a feeding container includes a feeding mechanism having a sleeve. In the feeding container, a first groove through which a projection formed in a holding member that holds a coating material passes and a second groove that extends from the first groove to an end surface of the sleeve are formed on an inner surface of the sleeve, and the first groove has a projection holding portion which is configured to accept the projection and disposed at a position away along the first groove from a connection portion of the first groove and the second groove.

In the feeding container, the projection is formed on the holding member that holds the coating material, and the first groove and the second groove through which the projection passes are formed on the inner surface of the sleeve. The second groove extends from the first groove through which the projection passes to the end surface of the sleeve. Therefore, since the projection of the holding member that holds the coating material is removed from the end surface of the sleeve by passing the first groove and the second groove, the holding member is easily removed from the sleeve. Therefore, it is possible to easily replace the holding member that holds the coating material. The first groove formed on the inner surface of the sleeve has the projection holding portion which is configured to accept the projection and disposed at the position away along the first groove from the connection portion with the second groove. The projection holding portion holds the projection that enters the projection holding portion. Therefore, since the projection of the holding member that holds the coating material is held by the projection holding portion, unintended detachment of the holding member from the sleeve is prevented. Therefore, unintended detachment of the coating material is prevented.

The feeding mechanism may include a first cylindrical member interposed between the sleeve and the holding member and a second cylindrical member positioned outside the first cylindrical member, one of the first cylindrical member and the second cylindrical member may include an inclined rib having an inclined surface inclined with respect to an axial direction of the first cylindrical member, the other of the first cylindrical member and the second cylindrical member may include a rib that is configured to engage with the inclined rib in a circumferential direction of the second cylindrical member, and when the projection enters the projection holding portion, a position of an end portion of the rib in the axial direction may coincide with a position of the inclined surface in the axial direction. In this case, when the projection of the holding member enters the projection holding portion of the sleeve, the end portion of the rib in the axial direction coincides with the position of the inclined surface formed in the inclined rib in the axial direction. When the second cylindrical member rotates relative to the first cylindrical member in this state, the rib abuts against the inclined surface of the inclined rib, and the first cylindrical member is moved in the axial direction with respect to the second cylindrical member. Therefore, since the first cylindrical member projects relative to the second cylindrical member, the holding member is pulled out from the second cylindrical member together with the first cylindrical member.

A convex portion may be formed in the second groove of the sleeve. In this case, when the projection of the holding member is present in the second groove, the projection abuts against the convex portion of the second groove formed in the sleeve. Therefore, when the projection abuts against the convex portion of the second groove, it is possible to further reduce a possibility that the holding member is unintentionally detached from the sleeve.

The second groove may have a widened portion in which a width of the second groove increases toward the end surface of the sleeve. In this case, since the widened portion of the second groove widens toward the end surface of the sleeve, it is possible to easily insert the projection into the second groove. Therefore, since the projection of the holding member that holds the coating material is easily inserted into the first groove through the second groove, it is possible to easily replace the coating material. The widened portion of the second groove of the sleeve allows the projection to be inserted into the second groove via the widened portion regardless of a position of the holding member with respect to the sleeve in the circumferential direction, so that the holding member is easily attached to the sleeve.

The widened portion may be defined by a first surface and a second surface that are inclined with respect to an axial direction of the sleeve, and an end position of the first surface in the axial direction on a side opposite to the end surface may be different from an end position of the second surface in the axial direction of the sleeve on a side opposite to the end surface. In this case, the end position of an end portion of the first surface in the axial direction is different from the end position of an end portion of the second surface in the axial direction. As a result, a distance between the end positions becomes wider than that when the end positions are placed at the same position in the axial direction. Therefore, it is possible to prevent the projection of the holding member from being caught between the end portions of the first and second surfaces in the second groove of the sleeve, and thus it is possible to more easily attach the holding member to the sleeve.

The widened portion may be partially defined by the second surface that is inclined with respect to the axial direction of the sleeve, and a position of the projection holding portion in the axial direction of the sleeve may be within a range of the second surface in the axial direction of the sleeve. In this case, since the position of the projection holding portion in the axial direction is within the range of the second surface in the axial direction, when the holding member and the sleeve are relatively rotated, the projection held by the projection holding portion is moved to the second surface of the second groove. Therefore, since the projection is moved to the second surface of the second groove by the relative rotation, the holding member is easily removed from the sleeve.

According to the present disclosure, the coating material is easily replaced.

DESCRIPTION OF EMBODIMENTS

Hereinafter, an embodiment of a feeding container according to the present disclosure will be described with reference to the drawings. In the description of the drawings, the same or corresponding elements are denoted by the same reference signs, and redundant description is appropriately omitted.

In the present disclosure, a "coating material" indicates a material to be applied to a coating target portion to be coated. The "coating material" may be, for example, a cosmetic or a cosmetic applicator such as a puff, a sponge, a tip, an impregnated body, or a brush, or a drawing material such as a brush or stationery. In the present embodiment, an example in which the coating material is the cosmetic is described.

The "cosmetic" is, for example, a lip stick, a lip liner, a lip gloss, an eyeliner, an eyebrow material, a beauty stick, or a concealer. The "cosmetic" may be a stick-type object containing a flexible material (for example, a semi-solid form, a soft solid form, a soil form, a jelly form, a mousse form, or paste containing these).

Figure 1A:
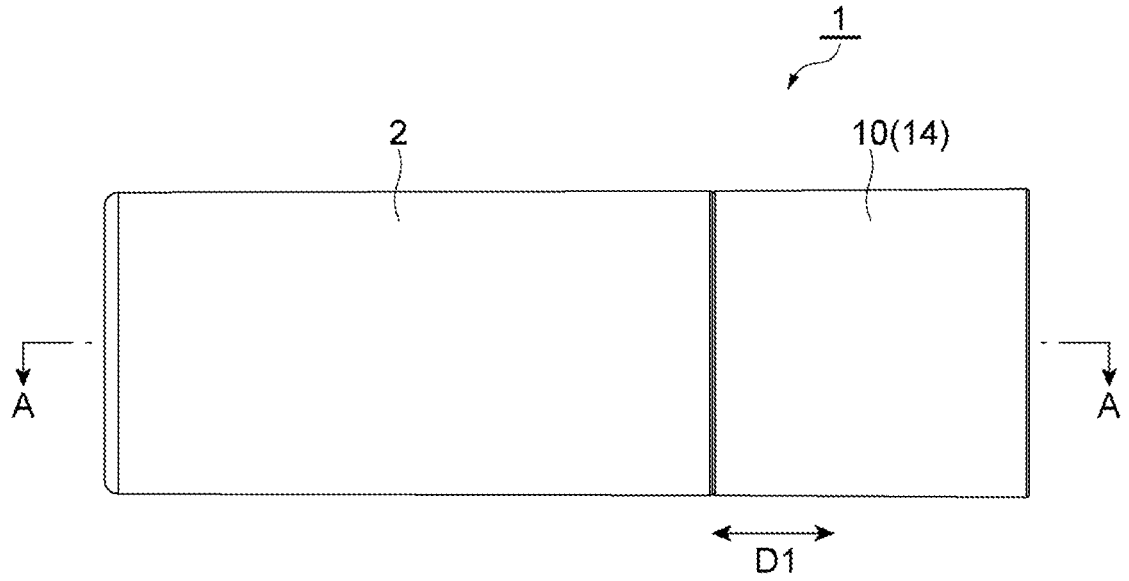
FIG. 1A is a side view showing a feeding container according to an embodiment.
Figure 1B:
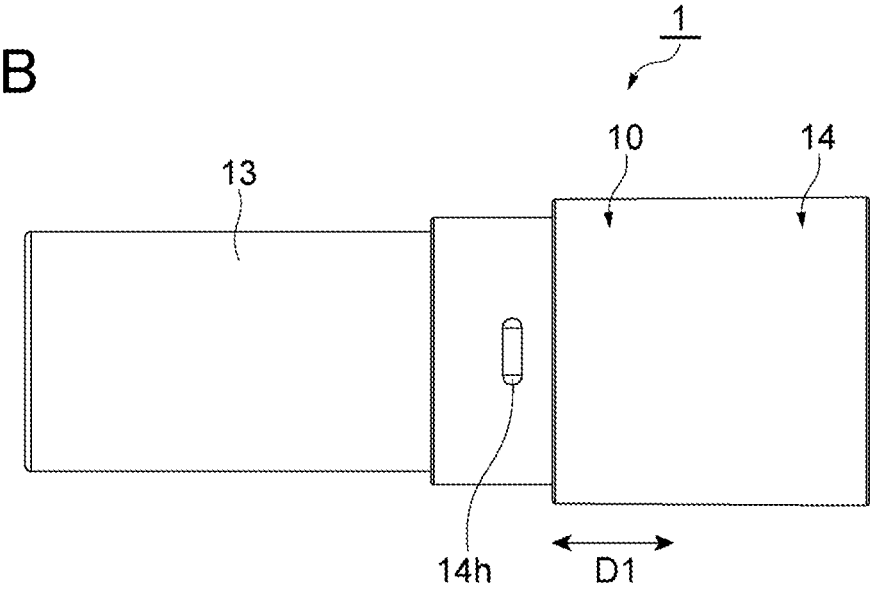
FIG. 1B is a side view showing a state where a cap is removed from the feeding container of FIG. 1A.
Figure 2:
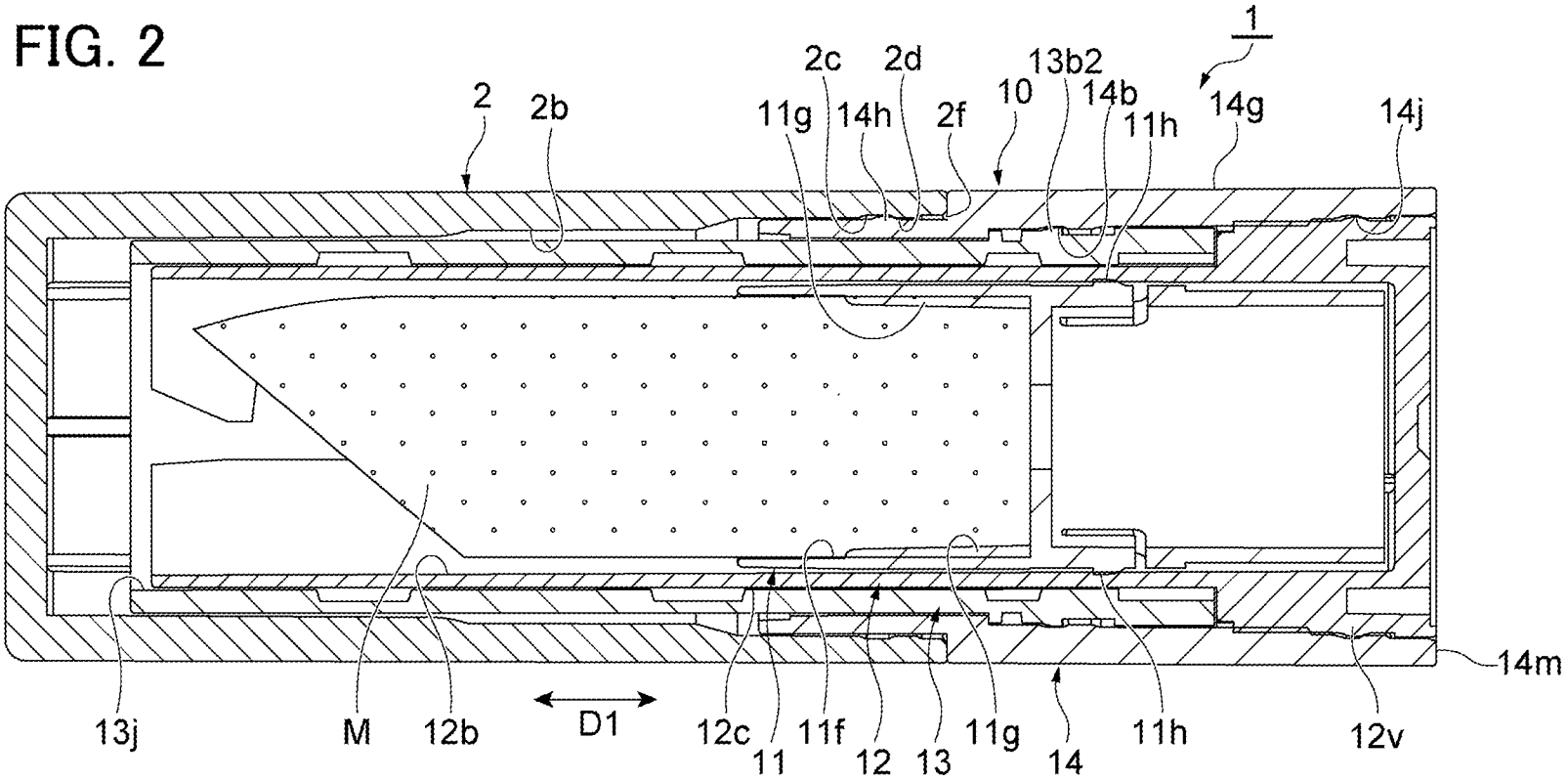
FIG. 2 is a cross-sectional view taken along a line A-A of the feeding container of FIG. 1A.

FIG. 1A is a side view of an exemplary feeding container 1 according to the embodiment. FIG. 1B is a side view showing a state where a cap 2 is removed from the feeding container 1. FIG. 2 is a cross-sectional view taken along a line A-A of FIG. 1A. As shown in FIGS. 1A, 1B, and 2, the feeding container 1 is, for example, a cosmetic feeding container that feeds out (pushes out) a cosmetic M accommodated in the feeding container 1 by an operation of a user. The feeding container 1 includes a feeding mechanism 10 that feeds out the cosmetic M and the cap 2 that is attached to the feeding mechanism 10.

The cap 2 is attached to the feeding mechanism 10 along an axial direction in which an axis of the feeding container 1 extends. In the present disclosure, the "axis" is an axis of a cylindrical body, and indicates, for example, a center line of the feeding container extending along a longitudinal direction of the feeding container. The "axial direction" is, for example, the longitudinal direction of the feeding container, and indicates a direction along the axis, that is, a direction in which the axis extends. A "radial direction" indicates a direction orthogonal to the axis, and a "circumferential direction" indicates a direction along a ring centered on the axis.

The cap 2 is made of, for example, acrylonitrile butadiene styrene (ABS) resin. The cap 2 has, for example, a bottomed cylindrical shape. The cap 2 has an opening 2*f* into which the feeding mechanism 10 is inserted along an axial direction D1 of the cap 2, and an inner circumferential surface 2*b* facing an outer circumferential surface of the feeding mechanism 10 inserted into the opening 2*f*. An annular concave portion 2*c* and an annular convex portion 2*d* with which the feeding mechanism 10 engages in the axial direction D1 are formed on the inner circumferential surface 2*b* of the cap 2, and the annular convex portion 2*d* is provided at a position closer to the opening 2*f* of the cap 2 than the annular concave portion 2*c*. The cap 2 is attached to the feeding mechanism 10 by the feeding mechanism 10 engaging with the annular concave portion 2*c* and the annular convex portion 2*d* of the cap 2 along the axial direction D1.

The feeding mechanism 10 feeds out the cosmetic M along the axial direction D1 to project the cosmetic M. Hereinafter, a feeding direction of the cosmetic M may be referred to as front, front side, or frontward (advance direction), and a direction opposite to the feeding direction of the cosmetic M may be referred to as "rear", "rear side" or "rearward" (retreat direction). However, these directions are for convenience of description, and do not limit arrangement positions of components and the like.

The feeding mechanism 10 includes, for example, a holding member 11 that holds the cosmetic M, a first cylindrical member 12 in which the holding member 11 is accommodated, a cylindrical sleeve 13 into which the first cylindrical member 12 is inserted, and a second cylindrical member 14 which is positioned outward in the radial direction of the first cylindrical member 12 and the sleeve 13 and to which the cap 2 is attached. In the feeding container 1 according to the present embodiment, the holding member 11 and the first cylindrical member 12 is attached to and detached from the sleeve 13 and the second cylindrical member 14. By attaching and detaching the holding member 11 and the first cylindrical member 12 to and from the sleeve 13 and the second cylindrical member 14, it is possible to replace the holding member 11 with the new cosmetic M and the first cylindrical member 12 in the feeding container 1.

Figure 3A:
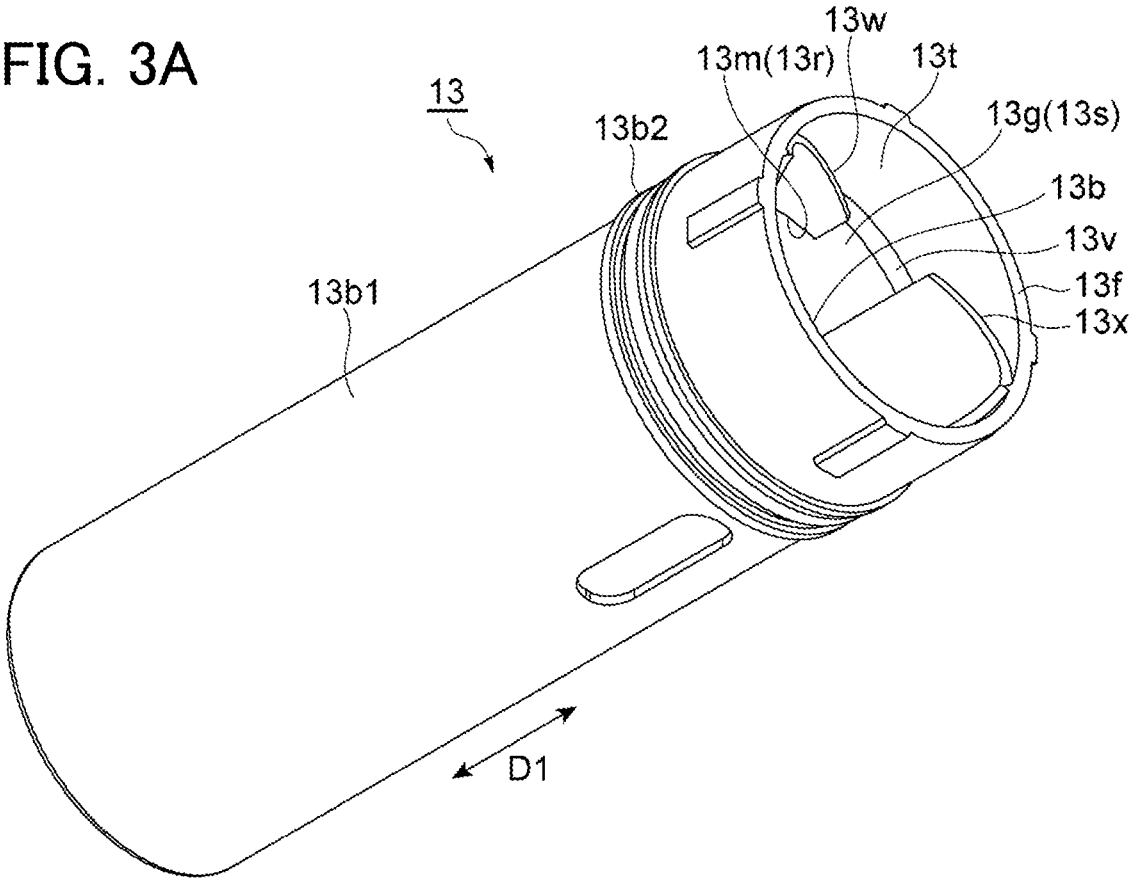
FIG. 3A is a perspective view showing a sleeve of the feeding container of FIGS. 1A and 1B.
Figure 3B:
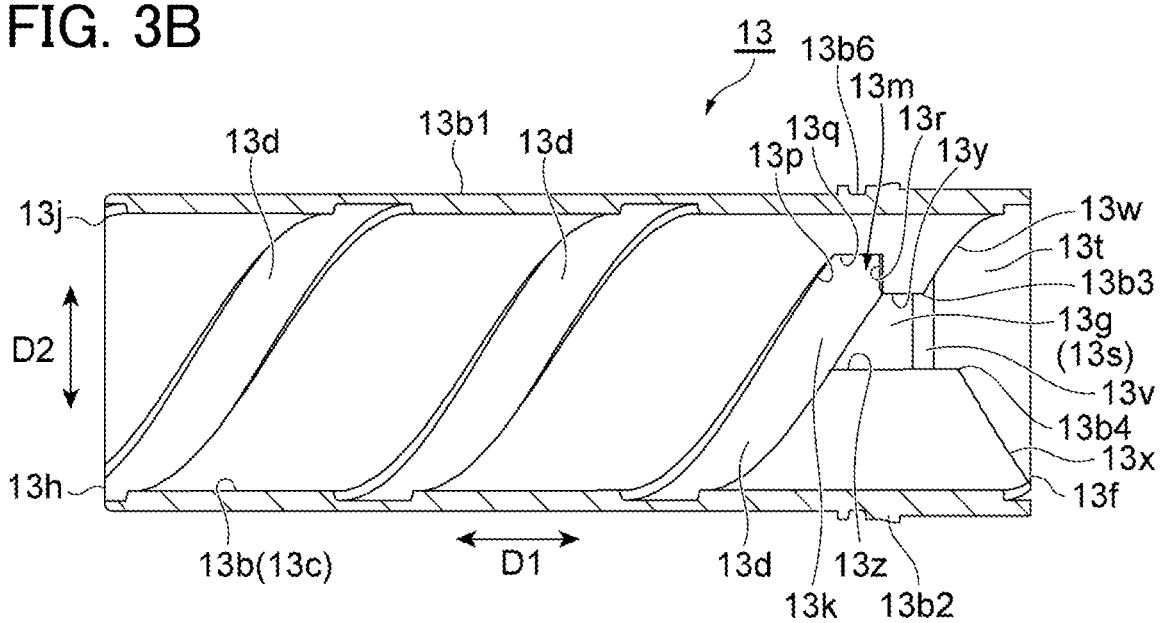
FIG. 3B is a cross-sectional view of the sleeve of FIG. 3A.

FIG. 3A is a perspective view showing the sleeve 13. FIG. 3B is a cross-sectional view of the sleeve 13 when the sleeve 13 is cut in a plane extending in the axial direction D1 and a radial direction D2. As shown in FIGS. 2, 3A, and 3B, the sleeve 13 has a cylindrical hole 13*b* that penetrates the sleeve 13 in the axial direction D1. The sleeve 13 is made of, for example, a polyethylene terephthalate (PET) resin. However, a material of the sleeve 13 may be the ABS resin or is appropriately changed.

The first cylindrical member 12 and the holding member 11 are inserted into the cylindrical hole 13*b* of the sleeve 13. For example, the first cylindrical member 12 and the holding member 11 are inserted into the cylindrical hole 13*b* from rearward. The sleeve 13 has an inner circumferential surface 13*c* facing the inserted first cylindrical member 12. The inner circumferential surface 13*c* is formed with a first groove 13*d* and a second groove 13*g* extending from the first groove 13*d* to an end surface 13*f* (rear end surface) of the sleeve 13.

The first groove 13*d* extends spirally from one end 13*h* of the sleeve 13 in the axial direction D1 along the axial direction D1. A projection 11*b* (see FIG. 6A), which will be described later, of the holding member 11 engages with the first groove 13*d*, and the holding member 11 rotates along the first groove 13*d* and moves along the axial direction D1. For example, the holding member 11 is movable back and forth while rotating with respect to the sleeve 13.

In the feeding mechanism 10, the holding member 11 advances relative to the sleeve 13, so that the cosmetic M held by the holding member 11 is fed out, and the cosmetic M projects from an opening 13*j* of the sleeve 13. As the holding member 11 retreats with respect to the sleeve 13, the cosmetic M held by the holding member 11 is carried back (retreated) to an inside of the sleeve 13.

The first groove 13*d* includes a projection holding portion 13*m* that is configured to accept the projection 11*b* of the holding member 11 and disposed at a position away along the first groove from a connection portion 13*k* of the first groove 13*d* and the second groove 13*g*. The projection holding portion 13*m* has, for example, a concave shape that is recessed in the circumferential direction of the sleeve 13. As an example, the projection holding portion 13*m* is defined by a first surface 13*p* extending from the connection portion 13*k* and extending in a direction inclined with respect to the axial direction D1, a bottom surface 13*q* extending from the first surface 13*p* in the axial direction D1, and a second surface 13*r* extending from an end portion of the bottom surface 13*q* on a side opposite to the first surface 13*p* in the circumferential direction of the sleeve 13.

The second groove 13*g* extends from the connection portion 13*k* along the axial direction D1, for example. As an example, the second groove 13*g* includes an extending portion 13*s* extending from the connection portion 13*k* in the axial direction D1, and a widened portion 13*t* extending from the extending portion 13*s* to the end surface 13*f*. In the second groove 13*g*, for example, a convex portion 13*v* against which the projection 11*b* of the holding member 11 abuts is formed. The convex portion 13*v*, for example, projects inward in the radial direction of the sleeve 13 and extends along the circumferential direction of the sleeve 13.

The widened portion 13*t* is defined by, for example, a first surface 13*w* and a second surface 13*x* that are inclined with respect to the axial direction D1. Each of the first surface 13*w* and the second surface 13*x* extends from the extending portion 3*s* to the end surface 13*f*, and the first surface 13*w* and the second surface 13*x* approach each other as the first surface 13*w* and the second surface 13*x* are separated from the end surface 13*f*. For example, at least one of the first surface 13*w* and the second surface 13*x* is curved outward in a direction away from each other. In an example of FIG. 3B, the first surface 13*w* is curved. For example, the second groove 13*g* has corner portions 3*b*3 and 13*b*4. The first surface 13*w* extends from the corner portion 13*b*3 toward the end surface 13*f*, and the second surface 13*x* extends from the corner portion 13*b*4 toward the end surface 13*f*.

A position of the first surface 13*w* in the axial direction D1 on a side opposite to the end surface 13*f* (for example, the corner portion 13*b*3) deviates from a position of the second surface 13*x* in the axial direction D1 on a side opposite to the end surface 13*f*(for example, the corner portion 13*b*4). That is, the corner portion 13*b*3 of the first surface 13*w* on the side opposite to the end surface 13*f* is positioned on a front side (a side opposite to the end surface 13*f*) of the corner portion 13*b*4 of the second surface 13*x* on the side opposite to the end surface 13*f*.

The extending portion 13*s* is defined by a third surface 13*y* extending from the projection holding portion 13*m* to the first surface 13*w* and a fourth surface 13*z* extending from the first groove 13*d* to the second surface 13*x*. For example, the third surface 3*y* and the fourth surface 13*z* extend in parallel with each other. As an example, a length of the third surface 13*y* in the axial direction D1 is shorter than a length of the fourth surface 13*z* in the axial direction D1.

The sleeve 13 has an outer circumferential surface 13*b*1 facing the cap 2 and the second cylindrical member 14. An annular projection 13*b*2 extending in the circumferential direction of the sleeve 13 is formed on the outer circumferential surface 13*b*1. When the annular projection 13*b*2 engages with an inner circumferential surface 14*b* of the second cylindrical member 14 in the axial direction D1, the sleeve 13 engages with the second cylindrical member 14 in the axial direction D1 and engages with the second cylindrical member 14 so as to be rotatable relative to the second cylindrical member 14.

Figure 4A:
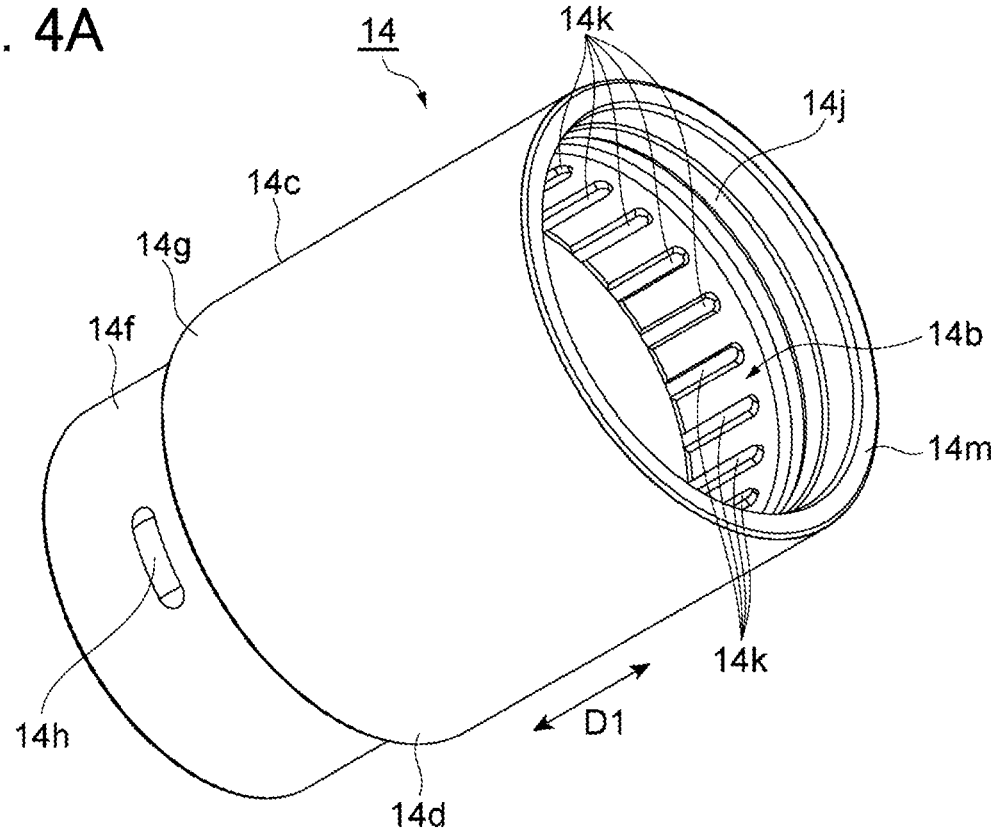
FIG. 4A is a perspective view showing a second cylindrical container of the feeding container of FIGS. 1A and 1B.
Figure 4B:
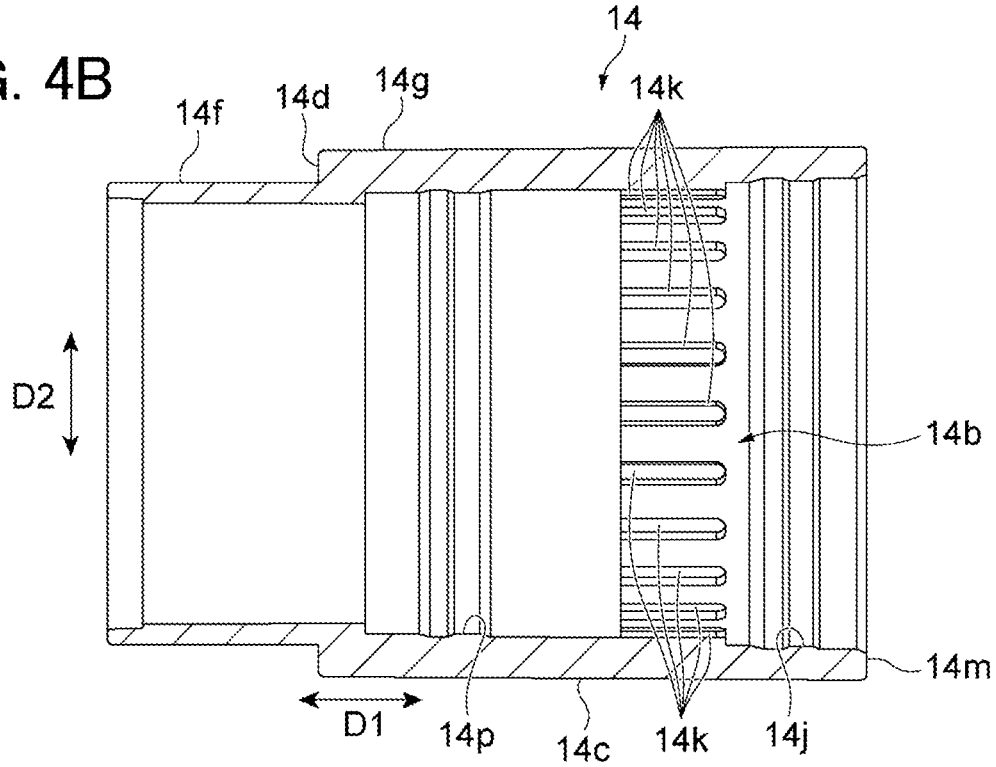
FIG. 4B is a cross-sectional view of the second cylindrical container of FIG. 4A.

FIG. 4A is a perspective view showing the second cylindrical member 14. FIG. 4B is a cross-sectional view of the second cylindrical member 14 when the second cylindrical member 14 is cut in the plane extending in the axial direction D1 and the radial direction D2. As shown in FIGS. 2, 4A, and 4B, the second cylindrical member 14 has a stepped cylindrical shape having a stepped portion 14*d* on an outer circumferential surface 14*c*. The second cylindrical member 14 is made of, for example, the ABS resin.

The second cylindrical member 14 includes a small diameter portion 14*f* positioned on one side of the stepped portion 14*d* in the axial direction D1 and a large diameter portion 14*g* positioned on the other side of the stepped portion 14*d* in the axial direction D1. A projection 14*h* is formed on the small diameter portion 14*f* on the outer circumferential surface 14*c*. When the projection 14*h* gets over the annular convex portion 2*d* of the cap 2 and enters the annular concave portion 2*c*, the cap 2 engages with the second cylindrical member 14. When the cap 2 engages with the second cylindrical member 14, the small diameter portion 14*f* enters an inside of the cap 2, and the large diameter portion 14*g* is exposed to an outside.

On the inner circumferential surface 14*b* of the second cylindrical member 14, an annular concave and convex portion 14*j* extending in the circumferential direction of the second cylindrical member 14 and ribs 14*k* extending in the axial direction D1 are formed. The annular concave and convex portion 14*j* is formed, for example, at one end (as an example, a rear end) of the second cylindrical member 14 in the axial direction D1. When the first cylindrical member 12 engages with the annular concave and convex portion 14*j*, the first cylindrical member 12 engages with the second cylindrical member 14 in the axial direction D1.

The second cylindrical member 14 includes, for example, a plurality of ribs 14*k*. For example, the plurality of ribs 14*k* are arranged along the circumferential direction of the second cylindrical member 14. When the rib 14*k* extending in the axial direction D1 engages with the first cylindrical member 12, the first cylindrical member 12 engages with the second cylindrical member 14 in the circumferential direction. That is, the second cylindrical member 14 engages with the first cylindrical member 12 so as to be synchronously rotatable.

The second cylindrical member 14 has, for example, an annular concave and convex portion 14*p* extending in the circumferential direction of the second cylindrical member 14 on a side opposite to an end surface 14*m* of the second cylindrical member 14 when viewed from the rib 14*k*. When the first cylindrical member 12 engages with the annular concave and convex portion 14*p*, the second cylindrical member 14 engages with the first cylindrical member 12 in the axial direction D1.

Figure 5A:
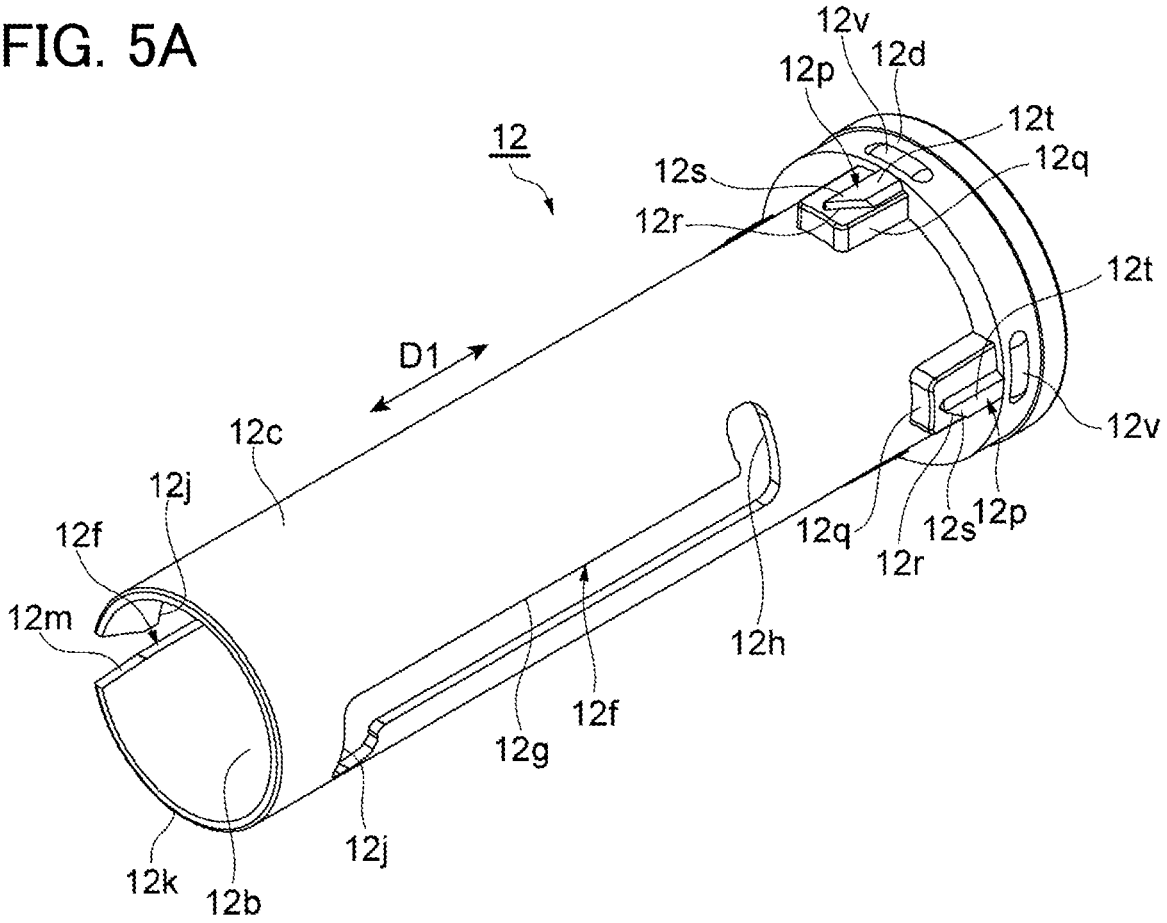
FIG. 5A is a perspective view showing a first cylindrical container of the feeding container of FIGS. 1A and 1B.
Figure 5B:
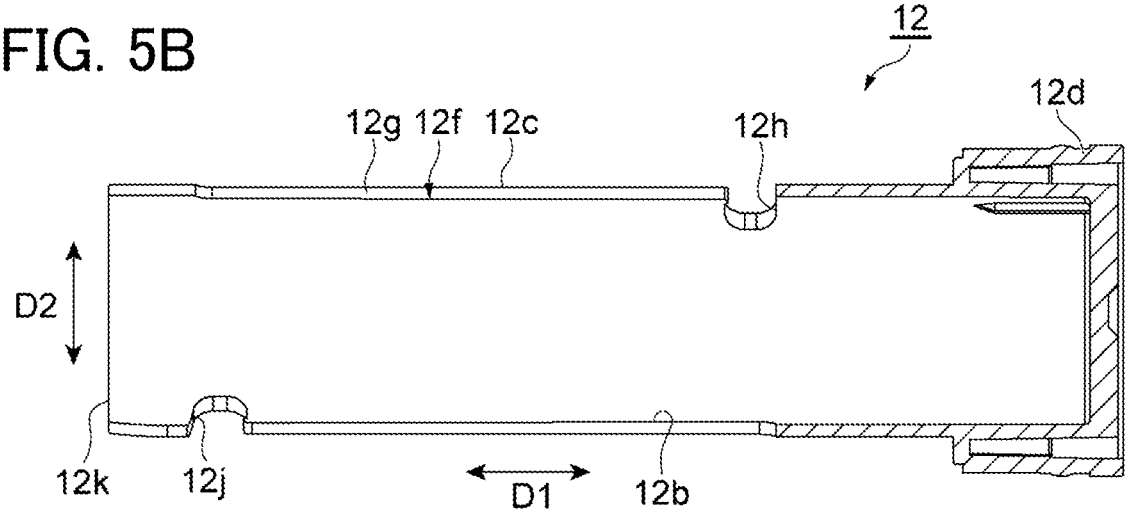
FIG. 5B is a cross-sectional view of the first cylindrical container of FIG. 5A.

FIG. 5A is a perspective view showing the first cylindrical member 12. FIG. 5B is a cross-sectional view of the first cylindrical member 12 when the first cylindrical member 12 is cut in the plane extending in the axial direction D1 and the radial direction D2. As shown in FIGS. 2, 5A, and 5B, the first cylindrical member 12 has, for example, a bottomed cylindrical shape. The first cylindrical member 12 is made of, for example, polypropylene (PP). The first cylindrical member 12 has a cylindrical hole 12*b* into which the holding member 11 holding the cosmetic M is inserted.

The first cylindrical member 12 includes an insertion portion 12*c* that is inserted into the sleeve 13, and an increased diameter portion 12*d* that increases in diameter at one end of the insertion portion 12*c* in the axial direction D1. The increased diameter portion 12*d* is a portion that enters one end (rear end) of the second cylindrical member 14 in the axial direction D1. The first cylindrical member 12 has an inclined rib 12*p* that engages with the second cylindrical member 14 in the circumferential direction. The first cylindrical member 12 includes, for example, a rib 12*v* that projects from the increased diameter portion 12*d*. As an example, a shape of the rib 12*v* as viewed from an outside in the radial direction D2 has an oval shape extending in the circumferential direction of the first cylindrical member 12. The first cylindrical member 12 includes, for example, a plurality of ribs 12*v*. The rib 12*v* engages with the annular concave and convex portion 14*j* of the second cylindrical member 14. When the rib 12*v* engages with the annular concave and convex portion 14*j*, the second cylindrical member 14 engages with the first cylindrical member 12 in the axial direction D1.

The inclined rib 12*p* extends along the axial direction D1, and has an inclined portion 12*s* on one side (front side) in the axial direction D1. The inclined portion 12*s* has an inclined surface 12*r* inclined with respect to the axial direction D1. An extending portion 12*t* extends from the inclined portion 12*s* along the axial direction D1. The first cylindrical member 12 includes, for example, a plurality of (for example, four) inclined ribs 12*p*.

The plurality of inclined ribs 12*p* are disposed, for example, at equal intervals along the circumferential direction of the first cylindrical member 12. Each of the plurality of inclined ribs 12*p* is provided, for example, outward in the radial direction of a convex portion 12*q*. The convex portion 12*q* projects from the insertion portion 12*c* and extends from the increased diameter portion 12*d* in the axial direction D1.

A through groove 12*f* through which the projection 11*b* of the holding member 11 penetrates is formed in the insertion portion 12*c*. The through groove 12*f* includes, for example, a first groove portion 12*g* extending in the axial direction D1, a second groove portion 12*h* extending in the circumferential direction of the first cylindrical member 12 at one end of the first groove portion 12*g*, and a third groove portion 12*j* extending in a direction opposite to the second groove portion 12*h* at the other end of the first groove portion 12*g*.

The first cylindrical member 12 includes, for example, two through grooves 12*f*, and one of the two through grooves 12*f* includes a fourth groove portion 12*m* extending from the third groove portion 12*j* to an end surface 12*k* of the first cylindrical member 12. The holding member 11 inserted into the first cylindrical member 12 is synchronously rotatable with respect to the first cylindrical member 12 when the projection 11*b* is positioned in the first groove portion 12*g*.

Figure 6A:
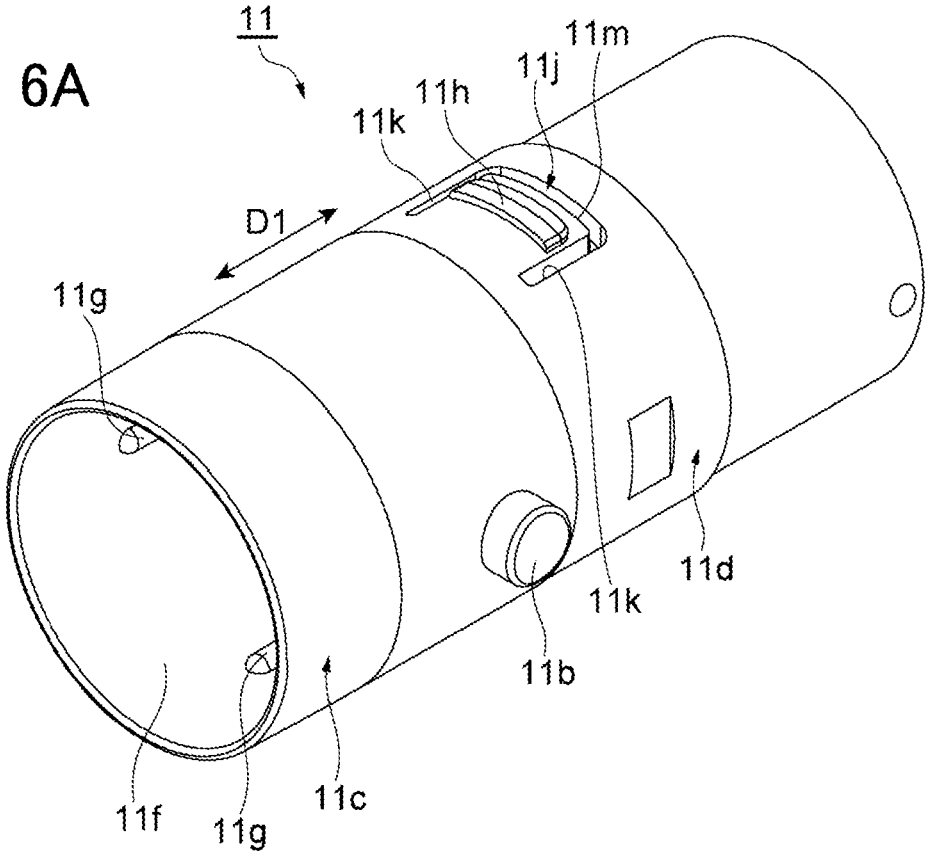
FIG. 6A is a perspective view showing a holding member of the feeding container of FIGS. 1A and 1B.
Figure 6B:
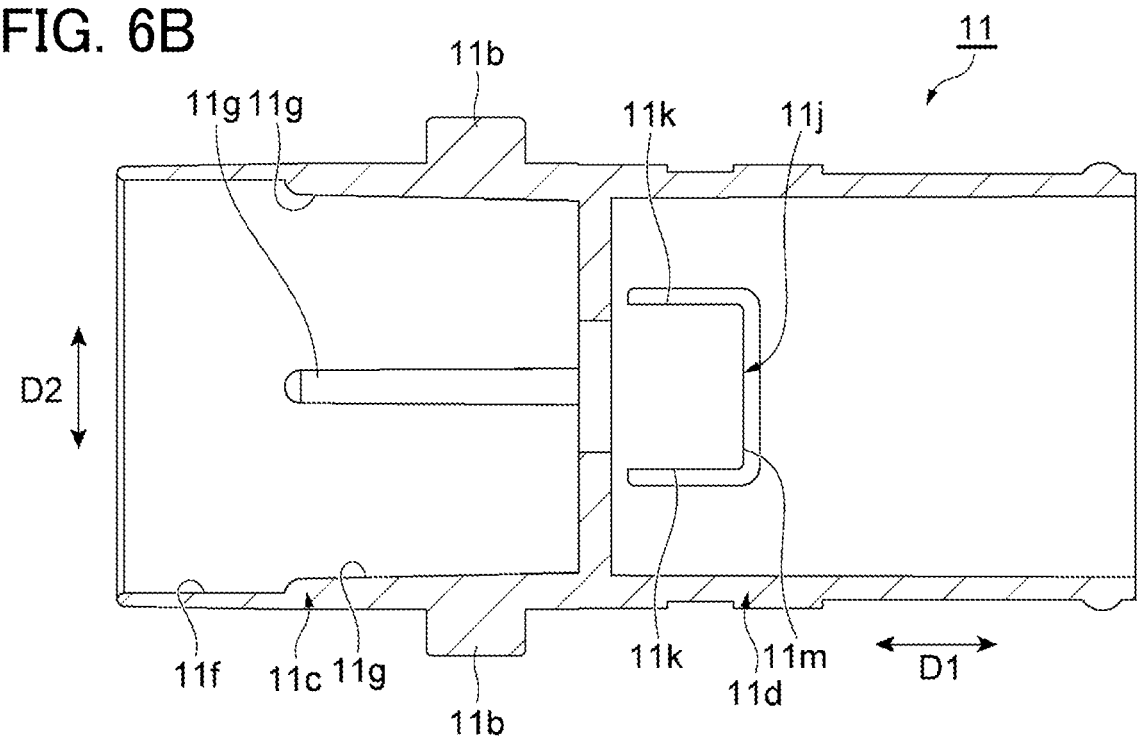
FIG. 6B is a cross-sectional view of the holding member of FIG. 6A.

FIG. 6A is a perspective view showing the holding member 11. FIG. 6B is a cross-sectional view of the holding member 11 when the holding member 11 is cut in the plane extending in the axial direction D1 and the radial direction D2. As shown in FIGS. 2, 6A, and 6B, the holding member 11 has a cylindrical shape in which one end and the other end in the axial direction D1 are opened. As an example, the holding member 11 has a cylindrical shape.

The holding member 11 includes a coating material holding portion 11*c* that holds the cosmetic M, and a cylindrical portion 11*d* that extends from the coating material holding portion 11*c* in the axial direction D1. The coating material holding portion 11*c* has, for example, a cylindrical shape. A rib 11*g* projecting inward in the radial direction is formed on an inner circumferential surface 11*f* of the coating material holding portion 11*c*.

The rib 11*g* bites into the cosmetic M filled in the coating material holding portion 11*c*. Since the rib 11*g* bites into the cosmetic M thus, the cosmetic M is firmly held by the holding member 11. The holding member 11 includes, for example, a plurality of (for example, four) ribs 11*g*, and each of the plurality of ribs 11*g* extends in the axial direction D1. The plurality of ribs 11*g* are disposed, for example, at equal intervals along the circumferential direction of the holding member 11.

The cylindrical portion 11*d* is, for example, a portion extending rearward from the coating material holding portion 11*c*. The cylindrical portion 11*d* has a projection 11*h* projecting outward in the radial direction of the holding member 11. A through hole 11*j* is formed around the projection 11*h* so as to penetrate the cylindrical portion 11*d* in the radial direction D2. The through hole 11*j* includes, for example, a pair of first through holes 11*k* extending in the axial direction D1 and arranged along the circumferential direction of the holding member 11, and a second through hole 11*m* extending in the circumferential direction of the holding member 11 between end portions of the pair of first through holes 11*k* in the axial direction D1.

The projection 11*h* is formed between the pair of first through holes 11*k* and on one side of the second through hole 11*m* in the axial direction D1. Thus, the projection 11*h* is formed around the through hole 11*j*, and thus has elasticity in the radial direction D2 of the holding member 11. The projection 11*h* contacts an inner circumferential surface of the first cylindrical member 12. When the projection 11*h* contacts the inner circumferential surface of the first cylindrical member 12, the projection 11*h* can function as a sliding resistance to prevent the cosmetic M from returning to an inside of the feeding container 1 at the time of use. In the above description, an example in which the holding member 11 has the projection 11*h* is described. However, the holding member 11 may not have the projection 11*h*. For example, an O-ring may be disposed in an annular concave portion 13*b*6 (see FIG. 3B) extending in the circumferential direction of the outer circumferential surface 13*b*1 of the sleeve 13.

The holding member 11 has the projection 11*b* projecting outward in the radial direction of the holding member 11. The projection 11*b* enters the spiral first groove 13*d* and the second groove 13*g* of the sleeve 13 above and moves along the first groove 13*d* and the second groove 13*g*. The projection 11*b* has, for example, a columnar shape. As an example, the holding member 11 has two projections 11*b*, and the projections 11*b* are formed on one side and the other side of the holding member 11 in the radial direction D2.

An example of a method of using the cosmetic M in the feeding container 1 configured as described above will be described. Hereinafter, a method of feeding out the cosmetic M in the feeding container 1 and a method of carrying back the cosmetic M will be described. First, in an initial state shown in FIG. 2 (a state where the cap 2 is attached to the feeding mechanism 10), the cap 2 is detached from the feeding mechanism 10.

Then, when the sleeve 13 and the second cylindrical member 14 are relatively rotated in one direction (hereinafter, also referred to as "feeding direction"), the first cylindrical member 12 and the holding member 11 rotate synchronously with the second cylindrical member 14, and the holding member 11 rotates relative to the sleeve 13. Due to the relative rotation of the holding member 11 with respect to the sleeve 13, the projection 11*b* of the holding member 11 spirally advances along the first groove 13*d* of the sleeve 13.

Figure 7:
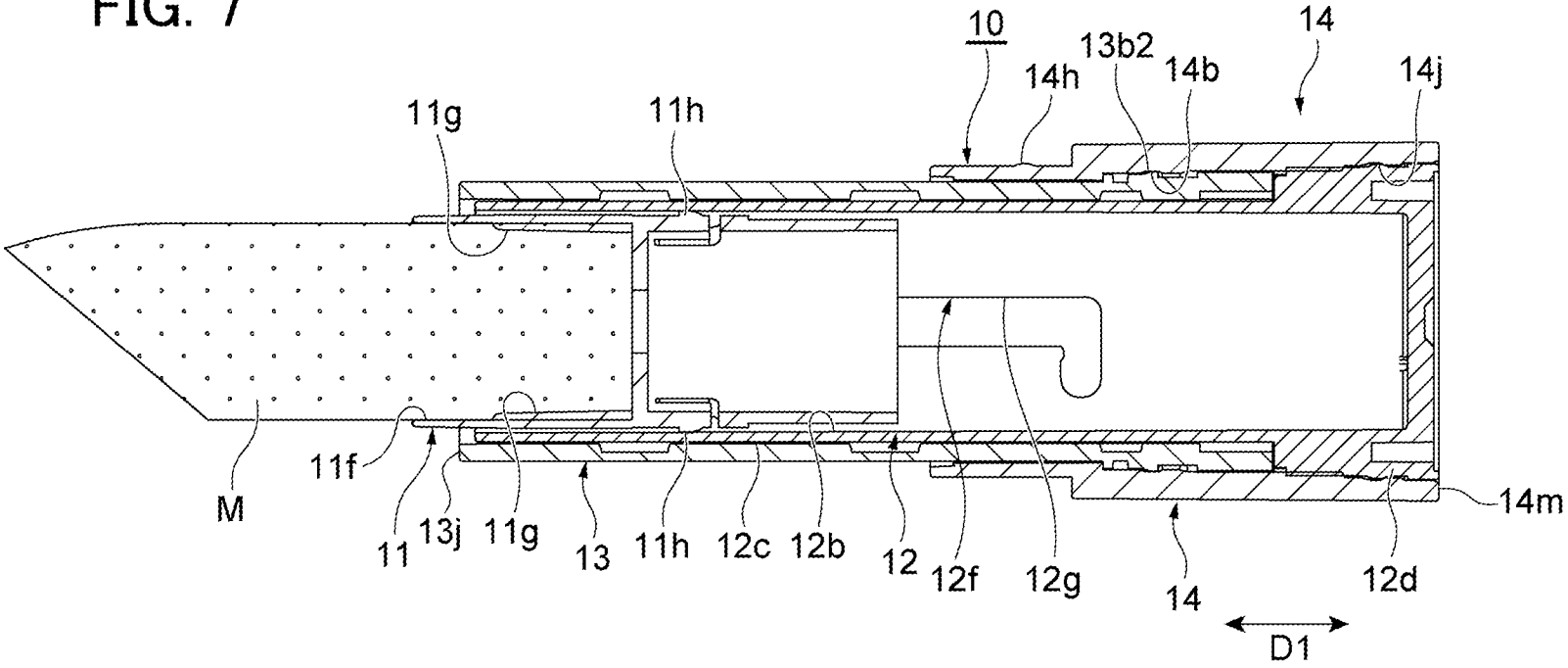
FIG. 7 is a cross-sectional view showing a state where the cap is removed from the feeding container of FIG. 2 and a coating material is fed out.

As shown in FIG. 7, the projection 11*b* spirally moves along the first groove 13*d* and advances along the first groove portion 12*g* of the first cylindrical member 12. Therefore, the holding member 11 advances with respect to the first cylindrical member 12, and the cosmetic M held by the holding member 11 is fed out from the first cylindrical member 12 and the sleeve 13, and the cosmetic M is provided for use.

When the cosmetic M is carried back, the sleeve 13 and the second cylindrical member 14 are relatively rotated in a direction opposite to the one direction (hereinafter, also referred to as a "return direction"). At this time, the first cylindrical member 12 and the holding member 11 that rotate synchronously with the second cylindrical member 14 rotate relative to the sleeve 13.

Due to the relative rotation, the projection 11*b* of the holding member 11 spirally retreats along the first groove 13*d* of the sleeve 13. The projection 11*b* spirally retreats along the first groove 13*d* and retreats along the first groove portion 12*g* of the first cylindrical member 12. Then, the cosmetic M held by the holding member 11 is immersed in the first cylindrical member 12 and the sleeve 13, and the cap 2 is attached to the feeding mechanism 10, thereby completing use of the feeding container 1.

Figure 8:
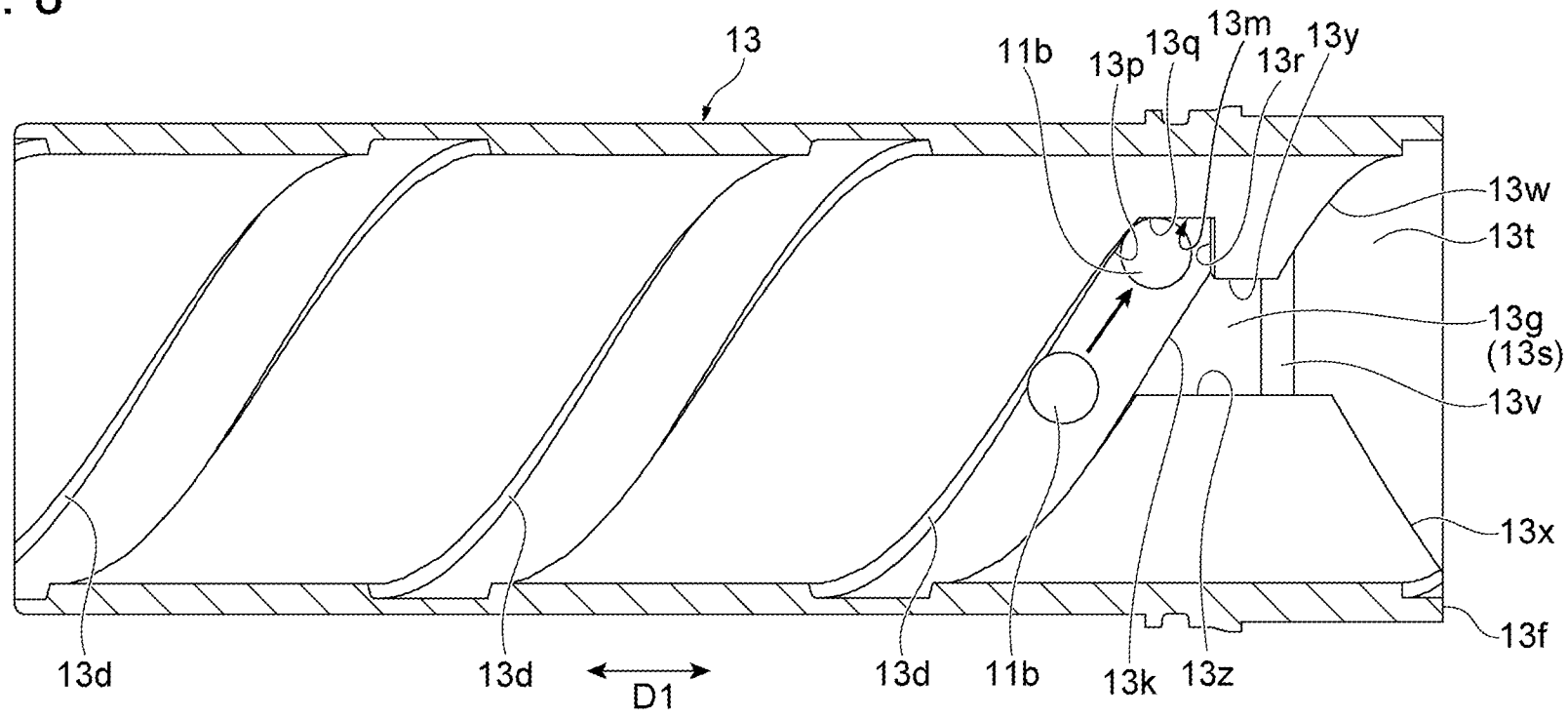
FIG. 8 is a view showing a positional relationship between a first groove and a second groove formed on an inner surface of the sleeve and a projection of the holding member according to the embodiment.

Next, for example, a procedure for replacing the holding member 11 and the first cylindrical member 12 from the sleeve 13 and the second cylindrical member 14 after using up the cosmetic M will be described. First, a procedure for removing the holding member 11 and the first cylindrical member 12 from the sleeve 13 and the second cylindrical member 14 will be described. As shown in FIG. 8, when the holding member 11 is positioned at a retreating limit with respect to the sleeve 13, the projection 11*b* of the holding member 11 is positioned on a front side of the connection portion 13*k* in the first groove 13*d*, and is positioned in the second groove portion 12*h* of the first cylindrical member 12.

Figure 9:
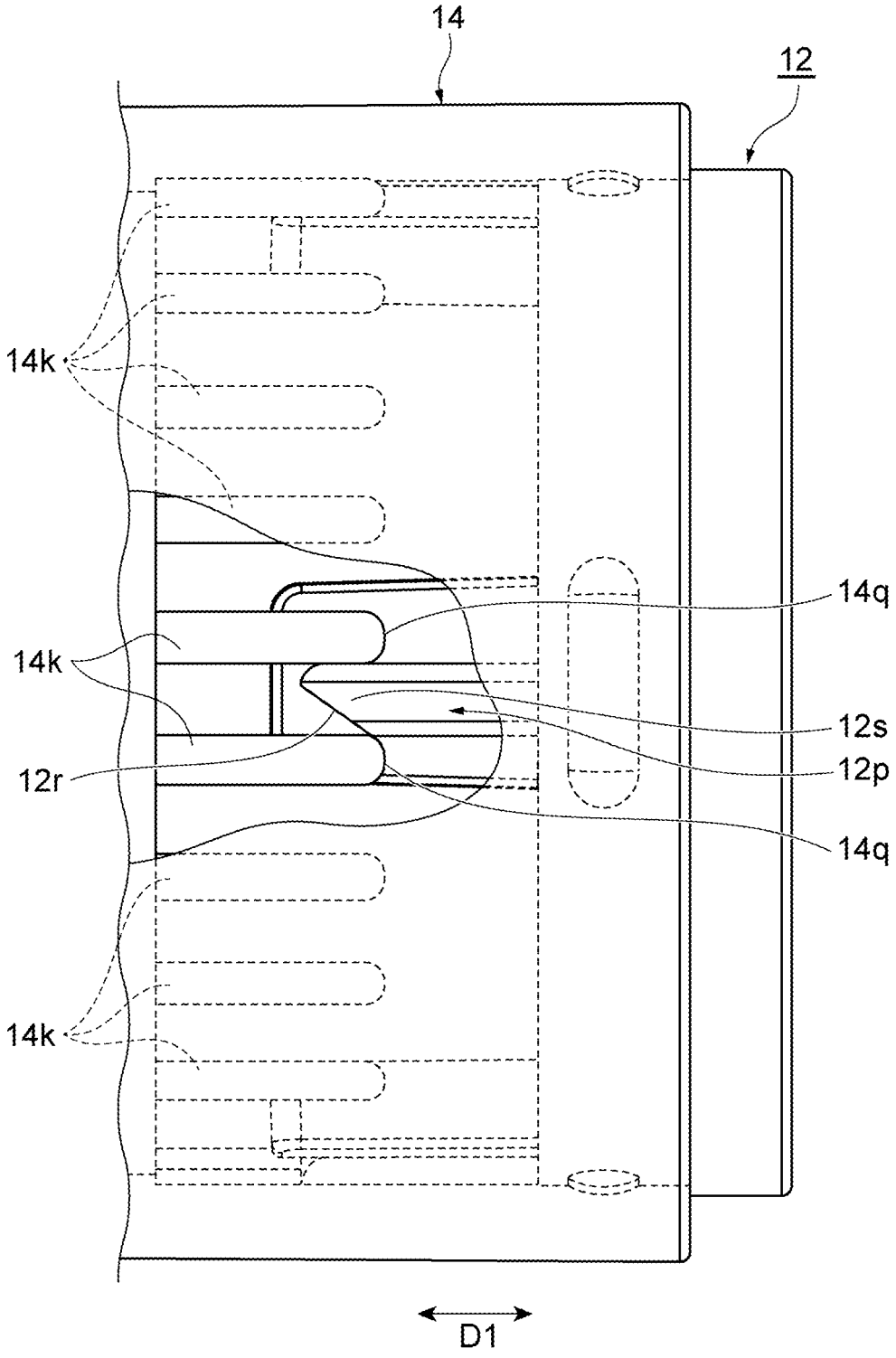
FIG. 9 is a view showing a positional relationship between a first cylindrical member and a second cylindrical member in a state where the projection enters a projection holding portion of the first groove of FIG. 8.

When the sleeve 13 and the second cylindrical member 14 further rotate relative to each other in the return direction in the above state, the projection 11*b* of the holding member 11 rotating synchronously with the second cylindrical member 14 enters the projection holding portion 13*m* of the first groove 13*d*. When the projection 11*b* enters the projection holding portion 13*m*, as shown in FIG. 9, the first cylindrical member 12 moves together with the holding member 11 with respect to the sleeve 13 and the second cylindrical member 14, and the first cylindrical member 12 projects (rearward) from the second cylindrical member 14.

When the first cylindrical member 12 projects from the second cylindrical member 14, the inclined rib 12*p* of the first cylindrical member 12 retreats with respect to the rib 14*k* of the second cylindrical member 14. When the first cylindrical member 12 projects from the second cylindrical member 14, an end portion 14*q* of the rib 14*k* in the axial direction D1 coincides with a position of the inclined portion 12*s* of the inclined rib 12*p* in the axial direction D1.

That is, a position of the end portion 14*q* of the rib 14*k* is positioned within a range of the inclined portion 12*s* in the axial direction D1, and the end portion 14*q* faces the inclined portion 12*s* along the circumferential direction of the first cylindrical member 12. In a state where the projection 11*b* enters the projection holding portion 13*m*, even if the first cylindrical member 12 is to be pulled out from the second cylindrical member 14, since the projection 11*b* is caught by the projection holding portion 13*m*, the first cylindrical member 12 is not detached from the second cylindrical member 14.

Figure 10:
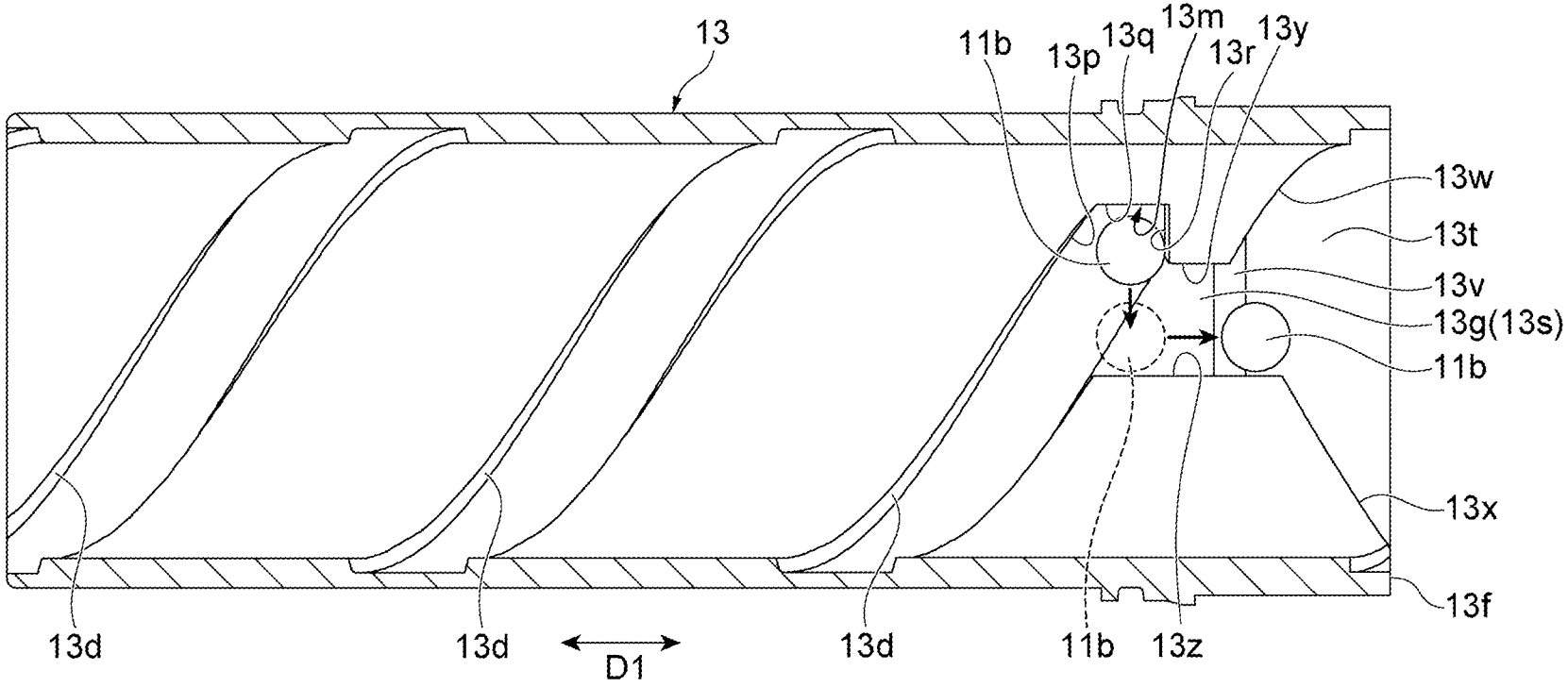
FIG. 10 is a view showing movement of the projection of the holding member when the holding member and the first cylindrical member rotate with respect to the sleeve and the second holding member in a state shown in FIG. 9.

When the sleeve 13 and the second cylindrical member 14 rotate relative to each other in the feeding direction in this state, as shown in FIG. 10, the projection 11*b* of the holding member 11 comes out of the projection holding portion 13*m* and moves to the second groove 13*g*, and then abuts against the convex portion 13*v*. At this time, since the projection 11*b* is caught by the convex portion 13*v*, it is possible to prevent unintended fall of the holding member 11 and the first cylindrical member 12.

Figure 11:
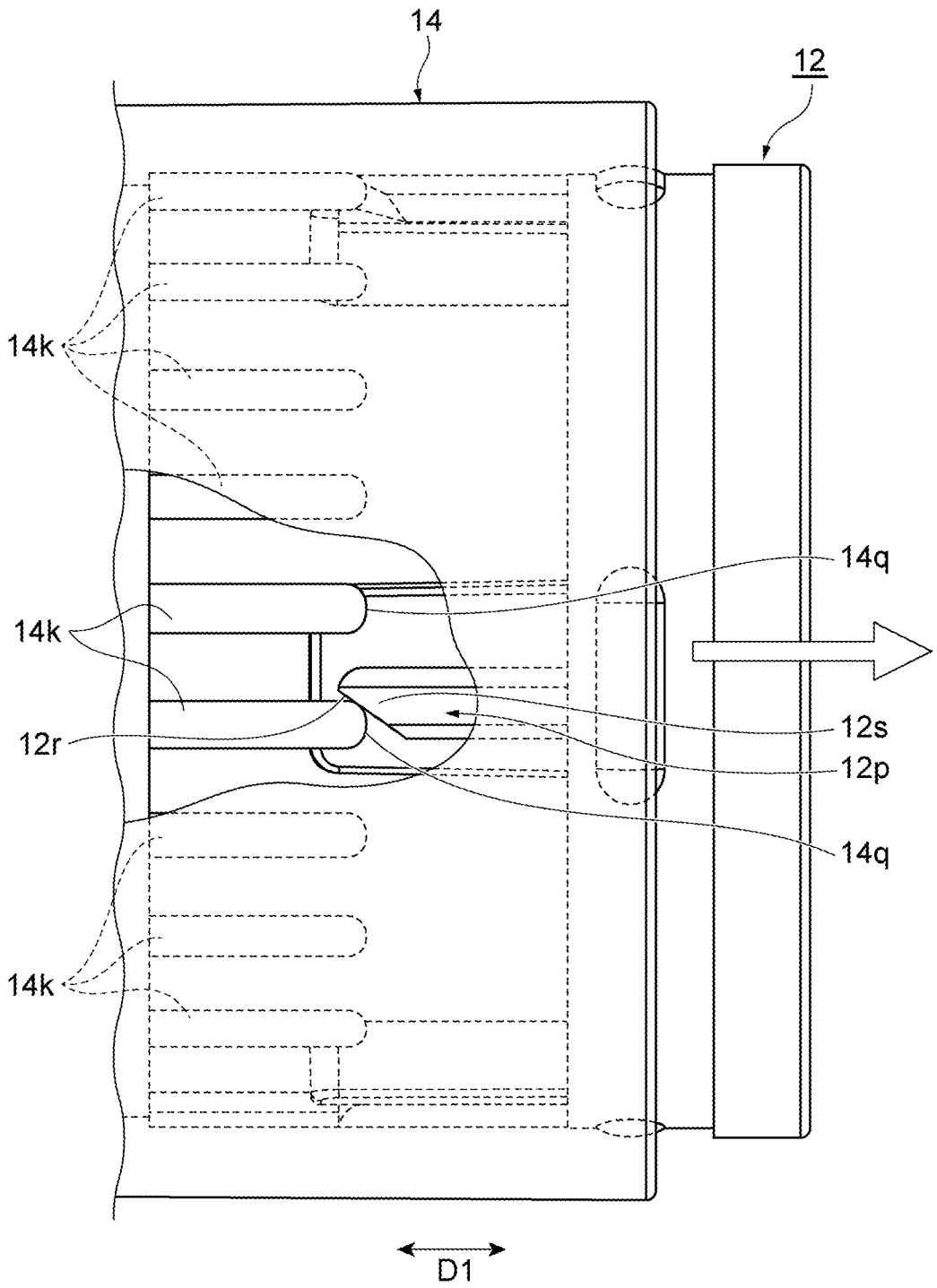
FIG. 11 is a view showing a position of the first cylindrical member when the holding member and the first cylindrical member rotate with respect to the sleeve and the second holding member in a state shown in FIG. 10.

When the projection 11*b* comes out of the projection holding portion 13*m*, as shown in FIG. 11, the holding member 11 and the first cylindrical member 12 relatively rotate with respect to the second cylindrical member 14, and the inclined portion 12*s* of the inclined rib 12*p* abuts against the end portion 14*q* of the rib 14*k*. When the inclined portion 12*s* abuts against the end portion 14*q* of the rib 14*k*, the end portion 14*q* slides obliquely along the inclined portion 12*s*, and the inclined portion 12*s* is pushed out (rearward) in the axial direction D1. Accordingly, the first cylindrical member 12 further projects from the second cylindrical member 14 in the axial direction D1.

Figure 12A:
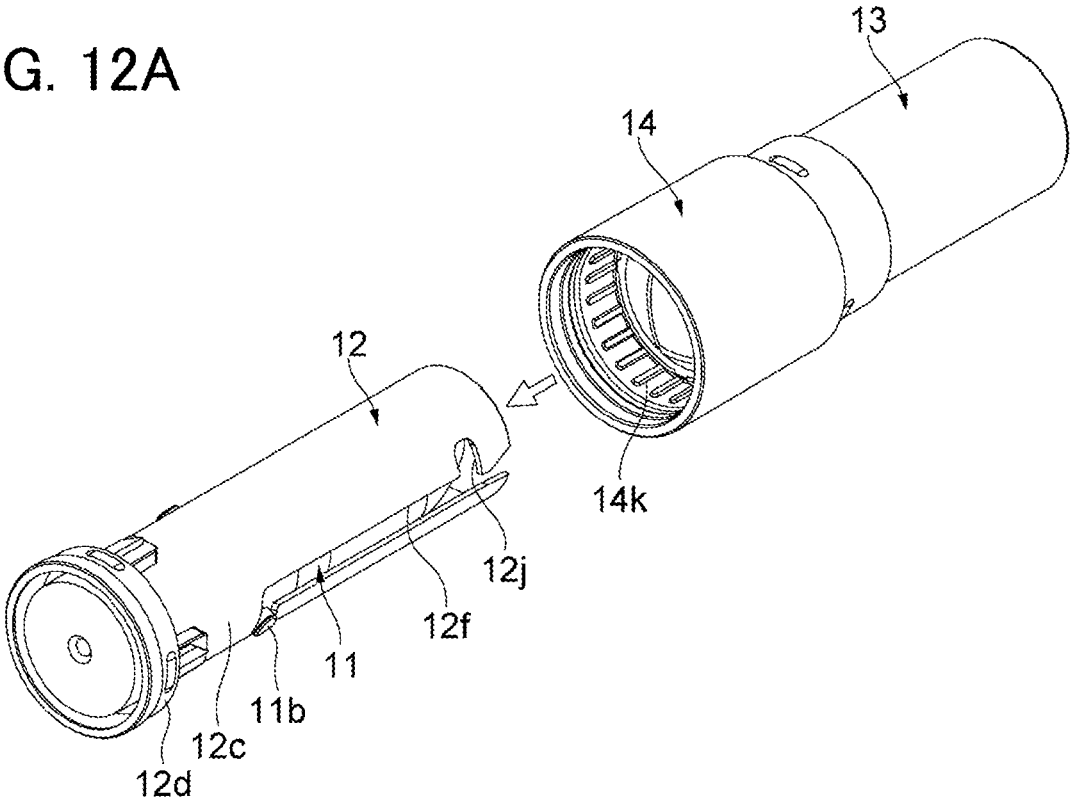
FIG. 12A is a perspective view showing a state where the first cylindrical member and the holding member come out of the second holding member and the sleeve.

In states shown in FIGS. 10 and 11, although the projection 11*b* is caught by the convex portion 13*v*, the first cylindrical member 12 and the holding member 11 is removed as shown in FIG. 12A by pulling out the first cylindrical member 12 from the second cylindrical member 14 in the axial direction D1. At this time, the projection 11*b* of the holding member 11 gets over the convex portion 13*v* of the sleeve 13, and the projection 11*b* comes out of the sleeve 13 via the widened portion 13*t*, so that the holding member 11 and the first cylindrical member 12 are detached from the sleeve 13 and the second cylindrical member 14.

Figure 12B:
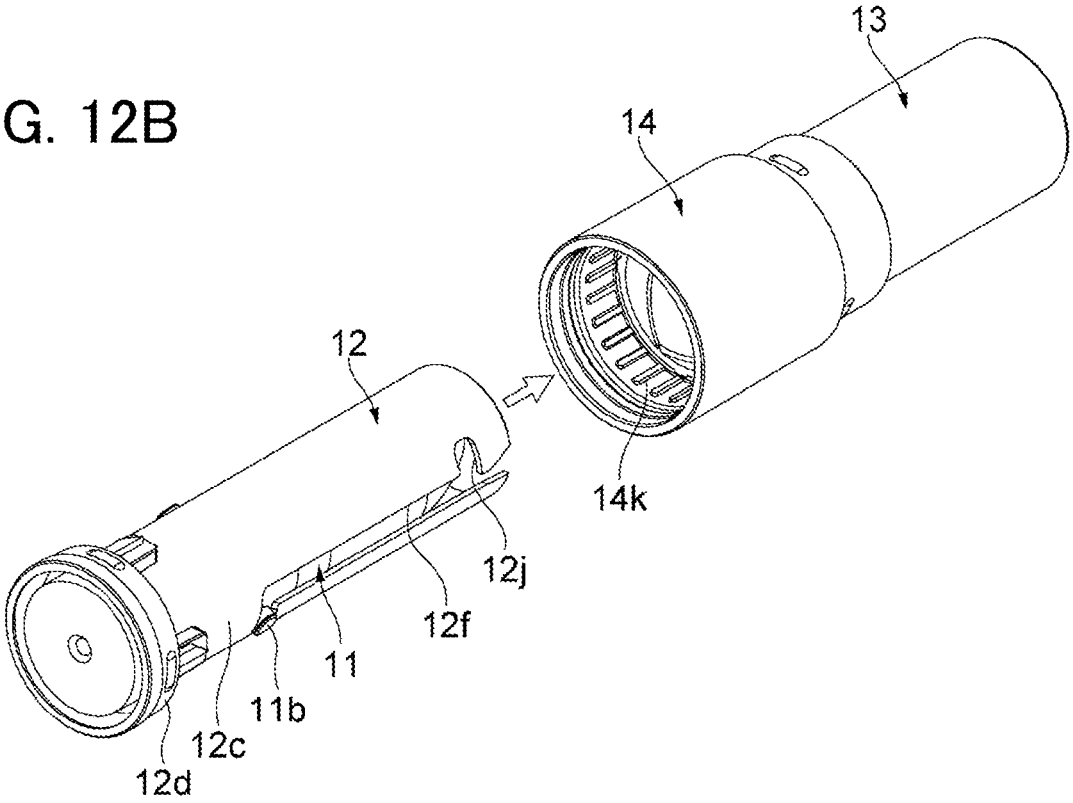
FIG. 12B is a perspective view showing a state where the holding member with the coating material and the first cylindrical member are attached to the second holding member and the sleeve.
Figure 13:
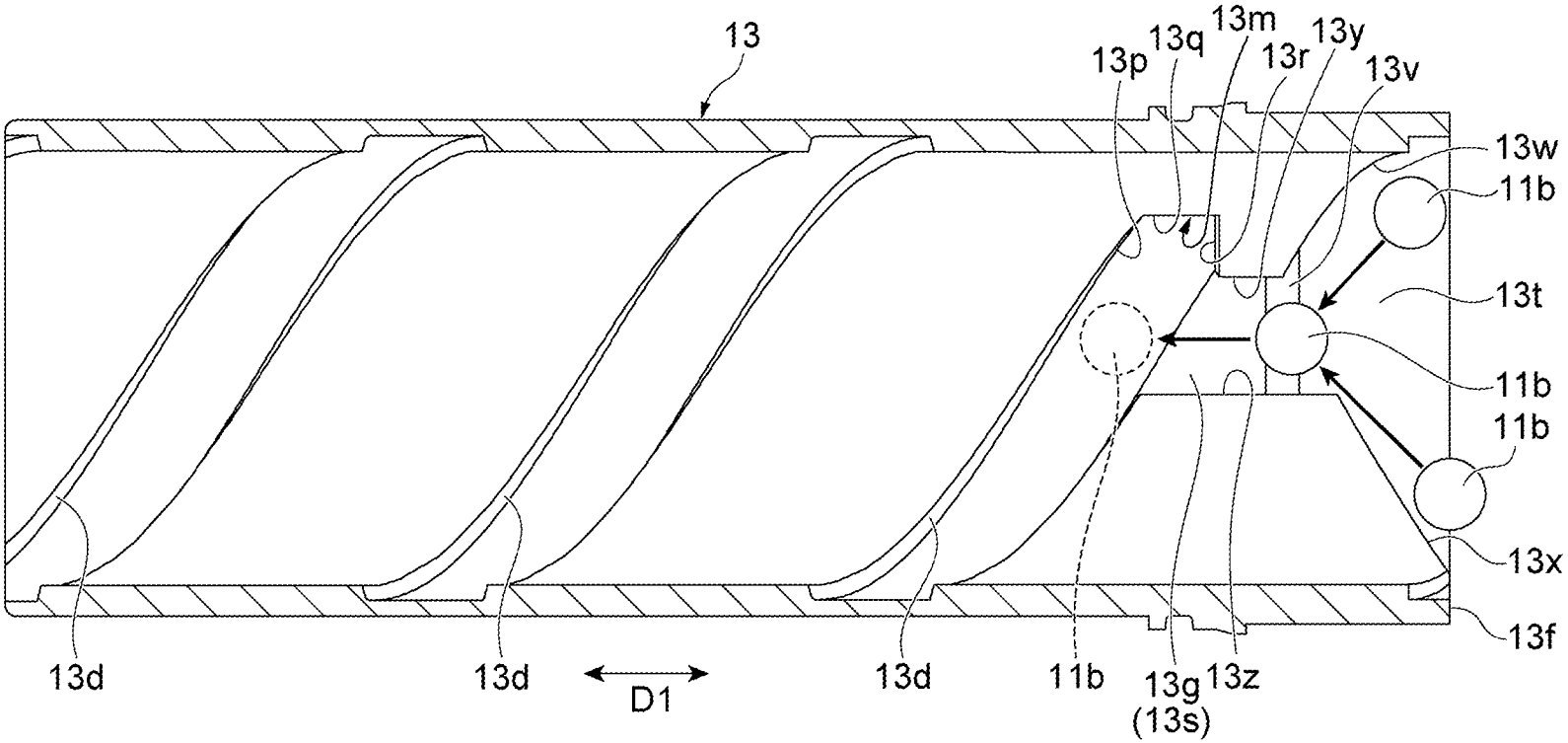
FIG. 13 is a view showing the positional relationship between the first groove and the second groove of the sleeve and the projection of the holding member at the time of attachment in FIG. 12B.

Next, for example, a procedure for attaching the holding member 11 and the first cylindrical member 12 to the sleeve 13 and the second cylindrical member 14 will be described. As shown in FIGS. 12B and 13, the first cylindrical member 12 and the holding member 11 are inserted into the second cylindrical member 14 along the axial direction D1. At this time, the projection 11*b* of the holding member 11 enters the widened portion 13*t* of the second groove 13*g* of the sleeve 13. Since the second groove 13*g* includes the widened portion 13*t*, the holding member 11 is smoothly inserted into the sleeve 13 regardless of a rotational position of the holding member 11 with respect to the sleeve 13. In the present embodiment, since the projection 11*b* is guided to at least one of the first surface 13*w* and the second surface 13*x*, the holding member 11 is smoothly inserted into the sleeve 13.

The projection 11*b* of the holding member 11 that enters the widened portion 13*t* of the sleeve 13 abuts against the convex portion 13*v* while being guided by the extending portion 13*s* in the second groove 13*g*. At this time, when the first cylindrical member 12 is further pushed into the second cylindrical member 14, the projection 11*b* gets over the convex portion 13*v* and moves to the first groove 13*d*, and the first cylindrical member 12 engages with the second cylindrical member 14 in the circumferential direction, and attachment of the first cylindrical member 12 is completed.

Next, an operation and effect obtained from the feeding container 1 according to the present embodiment will be described in detail. As shown in FIGS. 8 and 10, in the feeding container 1, the projection 11*b* is formed on the holding member 11 that holds the cosmetic M, and the first groove 13*d* and the second groove 13*g* through which the projection 11*b* passes are formed on the inner surface of the sleeve 13. The second groove 13*g* extends from the first groove 13*d* through which the projection 11*b* passes to the end surface 13*f* of the sleeve 13. Therefore, since the projection 11*b* of the holding member 11 that holds the cosmetic M is removed from the end surface 13*f* of the sleeve 13 by passing the first groove 13*d* and the second groove 13*g*, the holding member 11 is easily removed from the sleeve 13.

Since the holding member 11 holding the cosmetic M is easily replaced, the cosmetic M is easily replaced. The first groove 13*d* formed on the inner surface of the sleeve 13 has the projection holding portion 13*m* which is configured to accept the projection 11*b* and disposed at a position away along the first groove 13*d* from the connection portion 13*k* of the first groove 13*d* and the second groove 13*g*. The projection holding portion 13*m* holds the projection 11*b* that enters the projection holding portion 13*m*. Therefore, since the projection 11*b* of the holding member 11 that holds the cosmetic M is held by the projection holding portion 13*m*, unintended detachment of the holding member 11 from the sleeve 13 is prevented. Therefore, the unintended detachment of the cosmetic M is prevented.

As shown in FIGS. 8 and 9, the feeding mechanism 10 may include the first cylindrical member 12 interposed between the sleeve 13 and the holding member 11, and the second cylindrical member 14 positioned outside the first cylindrical member 12. The first cylindrical member 12 may include the inclined rib 12*p* having the inclined surface 12*r* inclined with respect to the first cylindrical member 12 in the axial direction D1. The second cylindrical member 14 may include the rib 14*k* that engages with the inclined rib 12*p* in the circumferential direction of the second cylindrical member 14. Then, when the projection 11*b* enters the projection holding portion 13*m*, the position of the end portion 14*q* of the rib 14*k* in the axial direction D1 may coincide with a position of the inclined surface 12*r* in the axial direction D1.

In this case, when the projection 11*b* of the holding member 11 enters the projection holding portion 13*m* of the sleeve 13, the end portion 14*q* of the rib 14*k* of the second cylindrical member 14 in the axial direction D1 coincides with the position of the inclined surface 12*r* formed in the inclined rib 12*p* of the first cylindrical member 12 in the axial direction D1. When the second cylindrical member 14 rotates relative to the first cylindrical member 12 in feeding direction in this state, the rib 14*k* of the second cylindrical member 14 abuts against the inclined surface 12*r* of the inclined rib 12*p* of the first cylindrical member 12, and the first cylindrical member 12 is moved in the axial direction D1 (rearward) with respect to the second cylindrical member 14. Therefore, since the first cylindrical member 12 projects relative to the second cylindrical member 14, the holding member 11 is pulled out from the second cylindrical member 14 together with the first cylindrical member 12.

The second groove 13*g* of the sleeve 13 may be formed with the convex portion 13*v* of the sleeve 13 that abuts against the projection 11*b* that moves in the axial direction D1. In this case, when the projection 11*b* of the holding member 11 is present in the second groove 13*g*, the projection 11*b* abuts against the convex portion 13*v* of the second groove 13*g* formed in the sleeve 13. Therefore, when the projection 11*b* abuts against the convex portion 13*v* of the second groove 13*g*, it is possible to further reduce a possibility that the holding member 11 is unintentionally detached from the sleeve 13.

The second groove 13*g* has the widened portion 13*t* in which a width of the second groove 13*g* increases toward the end surface 13*f* of the sleeve 13. In this case, since the widened portion 13*t* of the second groove 13*g* widens toward the end surface 13*f* of the sleeve 13, it is possible to easily insert the projection 11*b* into the second groove 13*g*. Therefore, since the projection 11*b* of the holding member 11 that holds the cosmetic M is easily inserted into the first groove 13*d* through the second groove 13*g*, it is possible to easily replace the cosmetic M. The widened portion 13*t* of the second groove 13*g* of the sleeve 13 allows the projection 11*b* to be inserted into the second groove 13*g* via the widened portion 13*t* regardless of a position of the holding member 11 with respect to the sleeve 13 in the circumferential direction, so that the holding member 11 is easily attached to the sleeve 13. As described above, for example, since the projection 11*b* is guided to the first surface 13*w* and the second surface 13*x*, the holding member 11 is smoothly inserted into the sleeve 13.

As shown in FIG. 3B, the widened portion 13*t* may be defined by the first surface 13*w* and the second surface 13*x* of the sleeve 13 that are inclined with respect to the axial direction D1, and the end position of the first surface 13*w* in the axial direction D1 on the side opposite to the end surface 3*f* (for example, the corner portion 3*b*3) deviates from the end position of the second surface 13*x* in the axial direction D1 on the side opposite to the end surface 13*f* (for example, the corner portion 13*b*4). In this case, the end position of an end portion of the first surface 13*w* in the axial direction D1 is different from the end position of an end portion of the second surface 13*x* in the axial direction D1. Therefore, it is possible to prevent the projection 11*b* of the holding member 11 from being caught between the end portions of the first and second surfaces in the second groove 13*g* of the sleeve 13, and thus it is possible to more easily attach the holding member 11 to the sleeve 13.

The embodiment of the feeding container according to the present disclosure is described above. However, the feeding container according to the present disclosure is not limited to the above embodiment, and may be modified or applied to other things without departing from a gist described in claims. That is, a configuration, shape, size, number, material, and arrangement mode of components that form the feeding container are not limited to the above embodiment, and is appropriately changed.

For example, in the above embodiment, the feeding container 1 in which the cap 2 is attached to and detached from the feeding mechanism 10 that includes the holding member 11, the first cylindrical member 12, the sleeve 13, and the second cylindrical member 14 is described. However, a configuration of the feeding mechanism of the feeding container is not limited to one including the holding member 11, the first cylindrical member 12, the sleeve 13, and the second cylindrical member 14, and is appropriately changed. For example, the feeding container may be one that does not have at least one of the first cylindrical member 12 and the second cylindrical member 14. In the above embodiment, an example in which the first cylindrical member 12 has the inclined rib 12*p* and the second cylindrical member 14 has the rib 14*k* is described. However, the first cylindrical member 12 may include a rib, and the second cylindrical member 14 may include an inclined rib.

In the above embodiment, an example in which the coating material is a cosmetic M is described. Thus, the coating material according to the present disclosure may be a liquid coating material including a stationery (drawing material) such as a lip gloss, an object for lip, an eye color, an eyeliner, a beauty lotion, cleaning liquid, a nail enamel, nail care solution, a nail remover, a mascara, a hair color, a hair cosmetic, an oral care material, massage oil, keratotic plug removing liquid, a foundation, a concealer, a skin cream, or a marking pen, a liquid medicine, or a muddy substance, and these coating materials may also be applied to the feeding container according to the present disclosure.

Figure 14:
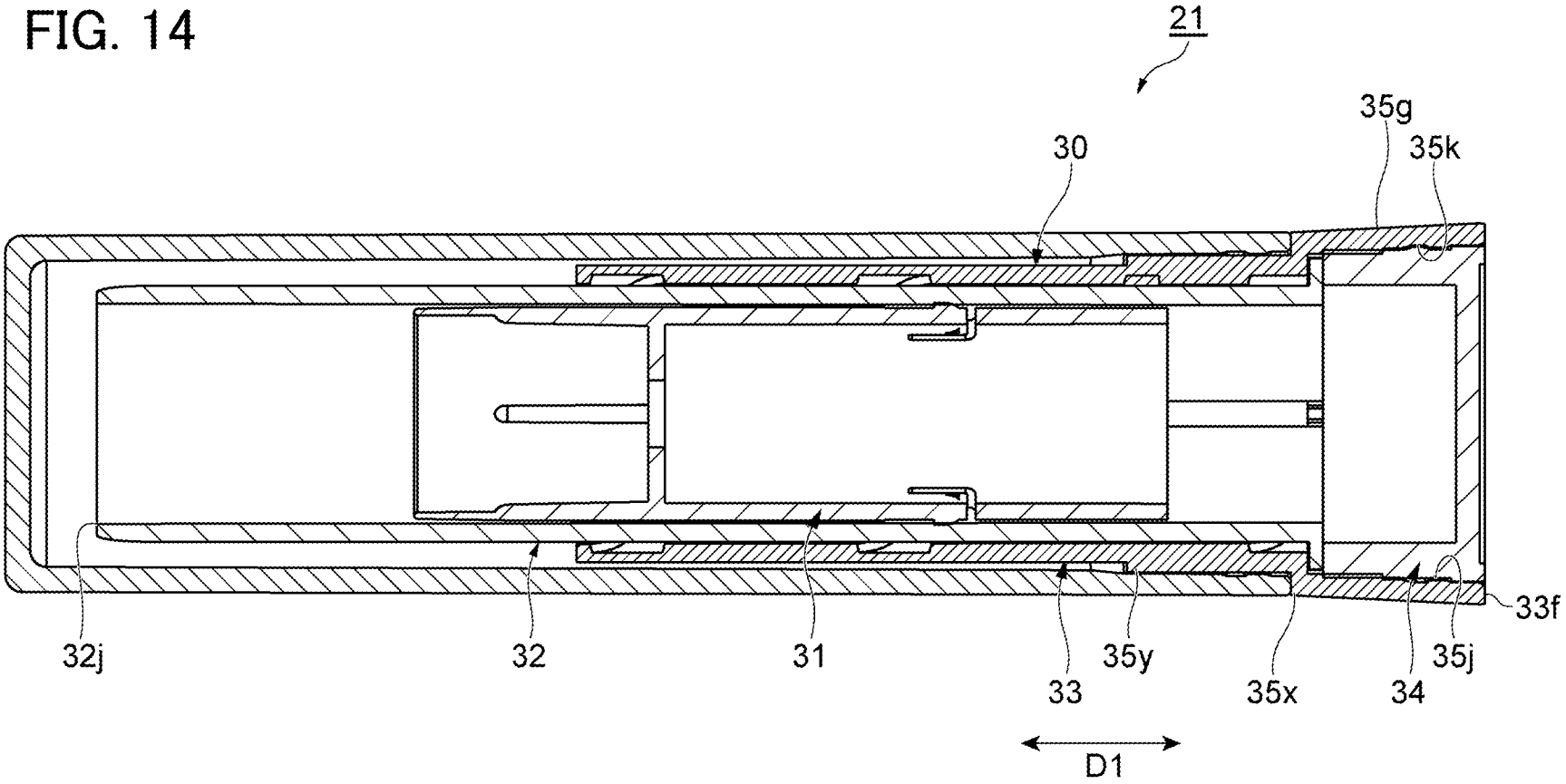
FIG. 14 is a cross-sectional view of a feeding container according to a modification.
Figure 15:
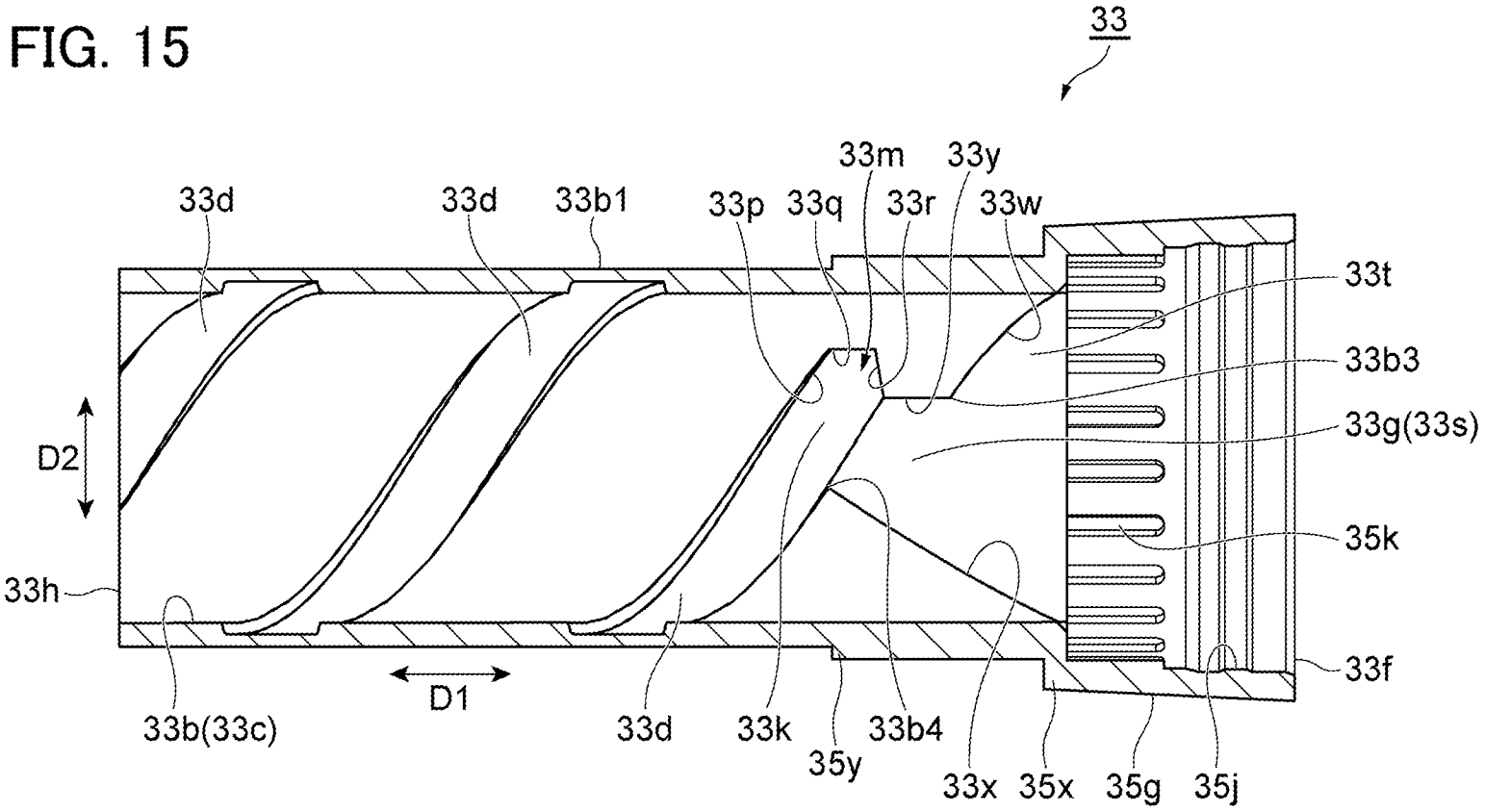
FIG. 15 is a cross-sectional view of a sleeve of the feeding container of FIG. 14.

Next, a feeding container 21 according to a modification will be described with reference to FIGS. 14 and 15. Since a part of a configuration of the feeding container 21 is the same as a part of the configuration of the feeding container 1 described above, the description of contents overlapping contents described above is omitted as appropriate. FIG. 14 is a cross-sectional view of the feeding container 21. FIG. 15 is a cross-sectional view of a sleeve 33 of the feeding container 21. As shown in FIGS. 14 and 15, the feeding container 21 is different from the feeding container 1 in that the feeding container 21 does not include the second cylindrical member 14.

The feeding container 21 includes a feeding mechanism 30. The feeding mechanism 30 includes, for example, a holding member 31 that holds the cosmetic M, a first cylindrical member 32 in which the holding member 31 is accommodated, the cylindrical sleeve 33 into which the first cylindrical member 32 is inserted, and a tail plug 34 that enters the sleeve 33 and seals the sleeve 33. In FIG. 14, the cosmetic M is not shown in order to show a configuration of the holding member 31 more clearly.

In the feeding container 21, the tail plug 34, the first cylindrical member 32, and the holding member 31 are attached to and detached from the sleeve 33. The sleeve 33 has a cylindrical hole 33*b* into which the first cylindrical member 32 and the holding member 31 are inserted. The sleeve 33 has an inner circumferential surface 33*c* facing the inserted first cylindrical member 32. A first groove 33*d* and a second groove 33*g* extending rearward from the first groove 33*d* are formed in the inner circumferential surface 33*c*.

The first groove 33*d* extends spirally from one end 33*h* of the sleeve 33. The holding member 31 has a projection similar to the projection 11*b*, and the projection engages with the first groove 33*d*. Therefore, similarly to the holding member 11 described above, the holding member 31 is movable back and forth while rotating with respect to the sleeve 33. In the feeding mechanism 30, the holding member 31 advances relative to the sleeve 33, so that the cosmetic M held by the holding member 31 is fed out, and the cosmetic M projects from an opening 32*j* of the first cylindrical member 32. As the holding member 31 retreats with respect to the sleeve 33, the cosmetic M held by the holding member 31 is carried back to an inside of the first cylindrical member 32.

The first groove 33*d* includes a projection holding portion 33*m* that is configured to accept the projection of the holding member 31 at a position away along the first groove 33*d* from a connection portion 33*k* of the first groove 33*d* and the second groove 33*g*. Similarly to the projection holding portion 13*m*, for example, the projection holding portion 33*m* is defined by a first surface 33*p* extending from the connection portion 33*k*, a bottom surface 33*q* extending from the first surface 33*p* in the axial direction D1 of the sleeve 33, and a second surface 33*r* extending from an end portion of the bottom surface 33*q* on a side opposite to the first surface 33*p* to the second groove 33*g*.

The second groove 33*g* has an extending portion 33*s* extending from the connection portion 33*k* in the axial direction and a widened portion 33*t* in which the width becomes widen toward the rear from the extending portion 33*s*. The widened portion 33*t* is defined by a first surface 33*w* and a second surface 33*x* that am inclined with respect to the axial direction D1. The extending portion 33*s* is defined by the second surface 33*x* and a third surface 33*y* extending in the axial direction D1. The second groove 33*g* has a corner portion 33*b*3 positioned between the first surface 33*w* and the third surface 33*y* and a corner portion 33*b*4 positioned between the connection portion 33*k* and the second surface 33*x*. The corner portion 33*b*4 is positioned at an end portion of the second surface 33*x* on a side opposite to an end surface 33*f*. A position of the corner portion 33*b*4 in the axial direction D1 coincides with a position of the projection holding portion 33*m* in the axial direction D1.

The sleeve 33 has an outer circumferential surface 33*b*1 that extends rearward from the one end 33*h*, a first stepped portion 35*y* that increases in diameter at a rear end of the outer circumferential surface 33*b*1, and a second stepped portion 35*x* that increases in diameter at a rear end of the first stepped portion 35*y*. The sleeve 33 has an inclined surface 35*g* that is inclined so as to increase in diameter from the second stepped portion 35*x* toward the end surface 33*f*, and the end surface 33*f* is provided at a rear end of the inclined surface 35*g*.

On a front side of the end surface 33*f* on the inner circumferential surface of the sleeve 33, an annular concave and convex portion 35*j* extending in the circumferential direction of the sleeve 33 and ribs 35*k* extending in the axial direction D1 are formed. The tail plug 34 engages with the annular concave and convex portion 35*j*. By engaging the tail plug 34 with the annular concave and convex portion 35*j*, the tail plug 34 engages with the sleeve 33 in the axial direction D1. The sleeve 33 includes, for example, a plurality of ribs 35*k*. When the rib 35*k* engages with the tail plug 34, the tail plug 34 engages with the sleeve 33 in the circumferential direction. That is, the tail plug 34 engages with the sleeve 33 so as to be synchronously rotatable.

In the feeding container 21 configured as described above, after the projection of the holding member 31 enters the projection holding portion 33*m*, the holding member 31 and the sleeve 33 are relatively rotated in the feeding direction, so that the projection of the holding member 31 moves in the circumferential direction and contacts the second surface 33*x* of the second groove 33*g*. The projection of the holding member 31 in contact with the second surface 33*x* is guided rearward along the second surface 33*x* and then separated from the sleeve 33. By separating the projection of the holding member 31 from the sleeve 33 thus, the holding member 31 is detached from the sleeve 33.

When the holding member 31 is attached to the sleeve 33, the holding member 31 is inserted into the sleeve 33 along the axial direction D1. At this time, the projection of the holding member 31 enters the widened portion 33*t* of the second groove 33*g* of the sleeve 33. Since the second groove 33*g* includes the widened portion 33*t*, the holding member 31 is smoothly inserted into the sleeve 33 regardless of a rotational position of the holding member 31 with respect to the sleeve 33. In the present embodiment, even when the projection of the holding member 31 does not enter the connection portion 33*k* along the axial direction D1 (a position of the projection of the holding member 31 in the circumferential direction deviates from a position of the connection portion 33*k* in the circumferential direction), since the projection is guided to at least one of the first surface 33*w* and the second surface 33*x*, the holding member 31 is smoothly inserted into the sleeve 33.

As described above, in the feeding container 21 according to the modification, since the projection of the holding member 31 that holds the cosmetic M is removed from the end surface 33*f* of the sleeve 33 by passing the second groove 33*g*, the holding member 31 is easily removed from the sleeve 33. Therefore, a similar operation and effect as that of the above feeding container 1 is obtained from the feeding container 21.

Further, in the feeding container 21 according to the modification, the widened portion 33*t* is partially defined by the second surface 33*x* of the sleeve 33 that is inclined with respect to the axial direction D1, and the position of the projection holding portion 33*m* in the axial direction D1 is within a range of the second surface 33*x* in the axial direction D1. That is, a position of at least a part of the projection holding portion 33*m* in the axial direction D1 coincides with a position of at least a part of the second surface 33*x* in the axial direction D1. Thus, since the position of the projection holding portion 33*m* in the axial direction D1 is within the range of the second surface 33*x* in the axial direction D1, when the holding member 31 and the sleeve 33 are relatively rotated, the projection held by the projection holding portion 33*m* is moved to the second surface 33*x* of the second groove 33*g*. Therefore, since the projection of the holding member 31 is moved to the second surface 33*x* of the second groove 33*g* by the relative rotation, the holding member 31 is further easily removed from the sleeve 33. The feeding container 21 according to the modification is described above. However, the feeding container according to the present disclosure is not limited to the above modification, and is further modified.

What is claimed is:

1. A feeding container comprising:

a feeding mechanism having a sleeve, wherein a first groove through which a projection formed in a holding member that holds a coating material passes and a second groove that extends from the first groove to an end surface of the sleeve are formed on an inner surface of the sleeve, wherein the first groove has a projection holding portion which is configured to accept the projection and disposed at a position away along the first groove from a connection portion of the first groove and the second groove, wherein the feeding mechanism includes:

a first cylindrical member interposed between the sleeve and the holding member: and a second cylindrical member positioned outside the first cylindrical member, wherein one of the first cylindrical member and the second cylindrical member includes an inclined rib having an inclined surface inclined with respect to an axial direction of the first cylindrical member, wherein another one of the first cylindrical member and the second cylindrical member includes a rib that is configured to engage with the inclined rib in a circumferential direction of the second cylindrical member, and wherein, when the projection enters the projection holding portion, a position of an end portion of the rib in the axial direction coincides with a position of the inclined surface in the axial direction.

2. The feeding container according to claim 1, wherein a convex portion is formed in the second groove of the sleeve.

3. The feeding container according to claim 1, wherein the second groove has a widened portion in which a width of the second groove increases toward the end surface of the sleeve.

4. The feeding container according to claim 3, wherein the widened portion is defined by a first surface and a second surface that are inclined with respect to an axial direction of the sleeve, and an end position of the first surface in the axial direction of the sleeve on a side opposite to the end surface is different from an end position of the second surface in the axial direction of the sleeve on a side opposite to the end surface.

5. The feeding container according to claim 4, wherein the widened portion is partially defined by the second surface that is inclined with respect to the axial direction of the sleeve, and a position of the projection holding portion in the axial direction of the sleeve is within a range of the second surface in the axial direction of the sleeve.

6. The feeding container according to claim 3, wherein the widened portion is partially defined by a second surface that is inclined with respect to an axial direction of the sleeve, and a position of the projection holding portion in the axial direction of the sleeve is within a range of the second surface in the axial direction of the sleeve.

7. The feeding container according to claim 1, wherein the second groove has a widened portion in which a width of the second groove increases toward the end surface of the sleeve.

* * * * *